US007206676B2

(12) United States Patent
Cross et al.

(10) Patent No.: US 7,206,676 B2
(45) Date of Patent: Apr. 17, 2007

(54) AUTOMATED MANIPULATION SYSTEM AND METHOD IN A TRANSIT SYSTEM

(75) Inventors: Michael Cross, Monroeville, PA (US); Kenneth A. Karg, Belle Vernon, PA (US); Gary S. Krut, Bethel Park, PA (US); William Ruhe, Gibsonia, PA (US); John T. DeGrave, McDonald, PA (US); Linda F. Clawson, Monroeville, PA (US); Chad Emahizer, Monroeville, PA (US)

(73) Assignee: Bombardier Transportation (Technology) Germany GmbH, Berlin (DE)

( * ) Notice: Subject to any disclaimer, the term of this patent is extended or adjusted under 35 U.S.C. 154(b) by 789 days.

(21) Appl. No.: 10/454,721

(22) Filed: Jun. 4, 2003

(65) Prior Publication Data

US 2004/0068361 A1 Apr. 8, 2004

Related U.S. Application Data

(60) Provisional application No. 60/385,531, filed on Jun. 4, 2002.

(51) Int. Cl.
*B61L 17/00* (2006.01)
*G08G 1/00* (2006.01)

(52) U.S. Cl. ..... 701/19; 701/117; 246/182 R

(58) Field of Classification Search ..... 701/19, 701/117; 246/182 R, 167 R; 340/539.17; 705/1, 13

See application file for complete search history.

(56) References Cited

U.S. PATENT DOCUMENTS 4,550,444 A 10/1985 Uebel
4,610,206 A 9/1986 Kubala et al.
4,655,421 A 4/1987 Jaeger
4,974,259 A 11/1990 Takahashi et al.
5,053,964 A * 10/1991 Mister et al. ..... 701/19
5,332,180 A * 7/1994 Peterson et al. ..... 246/3
5,390,880 A * 2/1995 Fukawa et al. ..... 246/167 R
5,420,883 A * 5/1995 Swensen et al. ..... 375/138
5,758,848 A 6/1998 Beule
5,785,283 A * 7/1998 Ehrenberger et al. ..... 246/62
5,803,411 A 9/1998 Ackerman et al.
6,032,905 A * 3/2000 Haynie ..... 246/3
6,144,900 A 11/2000 Ali et al.
6,175,784 B1 1/2001 Jicha et al.
6,195,023 B1 2/2001 Walsh et al.
6,246,956 B1 * 6/2001 Miyoshi et al. ..... 701/117
6,587,763 B2 * 7/2003 Ishikawa ..... 701/19

* cited by examiner

*Primary Examiner*—Tan Q. Nguyen
(74) *Attorney, Agent, or Firm*—The Webb Law Firm

(57) ABSTRACT

An automated manipulation system is provided for manipulating one or more vehicles in a transit system. The automated manipulation system includes a vehicle control mechanism in communication with a vehicle for receiving, processing and transmitting signals for controlling the operation of the vehicle. The system also includes a central control mechanism in wireless communication with the vehicle control mechanism for receiving, processing and transmitting signals for controlling the vehicle control mechanism and thereby initiating a manipulation operation in the vehicle. The manipulation operation is one of: adding a vehicle to the system; removing a vehicle from the system; coupling a first vehicle to a second vehicle; and uncoupling a first vehicle from a second vehicle. A method of automatically manipulating at least one vehicle in a transit system is also provided.

51 Claims, 30 Drawing Sheets

AUTOMATED MANIPULATION SYSTEM AND METHOD IN A TRANSIT SYSTEM

CROSS REFERENCE TO RELATED APPLICATIONS

This application claims benefit from Provisional Patent Application No. 60/385,531, filed Jun. 4, 2002.

BACKGROUND OF THE INVENTION

1. Field of the Invention

The present invention relates generally to the control and manipulation of vehicles in a transit system, such as adding a vehicle to the system, removing a vehicle from the system, and coupling or uncoupling vehicles from each other and, in particular, to an automated manipulation system using wireless communication and control to manipulate vehicles in a transit system.

2. Description of Related Art

Transit vehicles and transit systems, such as railway vehicles and railway systems, are used extensively throughout the world in order to move both people and goods from location to location. In order to add or remove a vehicle to or from a transit system, a transfer table or some other means of placing or removing the vehicle is required. Similarly, when coupling or uncoupling vehicles or trains to or from each other, some control technique is required to successfully complete the operation. Control systems and methods have been developed for assisting in an add/remove or couple/uncouple operation in a transit system. For example, U.S. Pat. No. 6,195,023 is directed to a system for positioning automated controlled vehicles on various tracks in a moving block system. However, this system requires human interaction and the manual positioning of the vehicles using switches driven and controlled by human force.

With respect to the coupling/uncoupling operation, systems and methods have also been developed to assist in this process. For example, U.S. Pat. No. 4,610,206 discloses a micro-controlled classification railroad yard that uses fixed block methods for coupling and uncoupling rail vehicles from each other. This system does not discuss the use of a communication based contactless control system, such as a moving block system. Similarly, U.S. Pat. No. 5,758,848 discloses an automatic switching system for use in connection with railroad freight trains, and this system also uses fixed block methods. Therefore, this system also does not discuss a contactless moving block system.

Therefore, there remains a need for an automated manipulation system and method for achieving a controlled addition and removal of vehicles from the transit system. There is a further need for an automated manipulation system and method that uses unique identifications for trains or individual transit vehicles for use in controlling the actions thereof. Accordingly, there remains a need for a system and method that allows for the addition or removal of vehicles to and from a vehicle path in a contactless moving block system. Still further, there is a need for a system and method that allows for the coupling and uncoupling of vehicles on a vehicle path in a contactless moving block system.

SUMMARY OF THE INVENTION

It is, therefore, an object of the present invention to provide an automated manipulation system and method that overcomes the deficiencies of the prior art. It is another object of the present invention to provide an automated manipulation system and method that allows for the automatic and controlled addition or removal of vehicles to and from a transit system. It is a still further object of the present invention to provide an automated manipulation system and method that uniquely identifies the vehicles or trains for use in controlling and operating thereon. It is yet another object of the present invention to provide an automated manipulation system and method that allows for the controlled coupling and uncoupling of vehicles to and from each other. It is another object of the present invention to provide an automated manipulation system and method that allows for the addition or removal of vehicles to and from a vehicle path and the coupling or uncoupling of vehicles on a vehicle path in a contactless moving block system.

In accordance with these objects, the present invention is directed to an automated manipulation system for manipulating one or more vehicles in a railway system. This system includes a vehicle control mechanism in communication with a vehicle for receiving, processing and transmitting signals that control the operation of the vehicle. In addition, the automated manipulation system includes a central control mechanism that is in wireless communication with the vehicle control mechanism for receiving, processing and transmitting signals for controlling the vehicle control mechanism and thereby initiating one or more manipulation operations in the vehicle. According to the present invention, the manipulation operation is at least one of: (i) adding a vehicle to the transit system; (ii) removing a vehicle from the transit system; (iii) coupling a first vehicle to a second vehicle; and (iv) uncoupling a first vehicle from a second vehicle.

In a preferred embodiment, the transit system includes at least one transfer table, which is a moving section of vehicle path configured to allow the vehicle to be moved between a transit system and a non-system area, such as a maintenance area, a transfer area and a storage area. In another preferred and non-limiting embodiment, the manipulation operation is initiated by the central control mechanism and requests the addition of a vehicle. The central control mechanism and/or the vehicle control mechanism: (i) verifies that the vehicle includes the vehicle control mechanism and that the vehicle is positioned on the transfer table; (ii) verifies and controls the relative positioning of other vehicles in the transit system; (iii) commands the transfer table to move into operable communication with the vehicle path in the transit system; and (iv) adds a vehicle individually to the transit system or adds the vehicle to a train, where a train includes one or more vehicles.

In another preferred embodiment, the manipulation operation is initiated by the central control mechanism and requests the removal of a vehicle. The central control mechanism and/or the vehicle control mechanism: (i) verifies that an empty transfer table is in operable communication with the vehicle path in the transit system and/or positions an empty transfer table in operable communication with the vehicle path in the transit system; (ii) routes the vehicle to be removed to the transfer table; (iii) berths the vehicle to be removed from the transfer table; (iv) properly aligns the vehicle to be removed on the transfer table; and (v) removes the vehicle individually from the transit system via the transfer table and/or uncouples the vehicle from a subsequent vehicle on a train and removes this vehicle from the transit system via the transfer table.

In a further preferred and non-limiting embodiment, the manipulation system includes a first vehicle control mechanism in communication with a first vehicle for receiving, processing and transmitting signals for controlling the operation of the first vehicle, and a second vehicle control mechanism in communication with a second vehicle for receiving, processing and transmitting signals for controlling the operation of the second vehicle.

In this embodiment, the manipulation operation is initiated by the central control mechanism and requests the coupling of the first vehicle to the second vehicle. The central control mechanism, the first vehicle control mechanism and/or the second vehicle control mechanism: (i) verifies the train length and the existence of a communication link between the central control mechanism, the first vehicle control mechanism and the second vehicle control mechanism; (ii) holds the second vehicle on the transfer table; (iii) routes the first vehicle in the transit system to a coupling location; (iv) maintains the first vehicle position at the coupling location; (v) verifies the first vehicle position at the coupling location; (vi) routes the second vehicle from the transfer table to the coupling location in the direction of the coupling location; and (vii) couples the second vehicle to the first vehicle at the coupling location.

In another embodiment, the manipulation operation is initiated by the central control mechanism and requests the uncoupling of the first vehicle from the second vehicle in a train. The central control mechanism, the first vehicle control mechanism and/or the second vehicle control mechanism: (i) verifies the train length and the existence of a communication link between the central control mechanism, the first vehicle control mechanism and the second vehicle control mechanism; (ii) verifies the position of other trains in the transit system; (iii) assigns a lead control vehicle in the train; and (iv) uncouples the first vehicle from the second vehicle.

The present invention is also directed to a method of automatically manipulating one or more vehicles in a system. This method includes the steps of: (i) providing a vehicle control mechanism in communication with the vehicle for controlling the operation of the vehicle; (ii) providing a central control mechanism in wireless communication with the vehicle control mechanism for controlling the vehicle control mechanism; and (iii) initiating a manipulation operation in the vehicle.

The present invention, both as to its construction and its method of operation, together with the additional objects and advantages thereof, will best be understood from the following description of exemplary embodiments when read in connection with the accompanying drawings.

DETAILED DESCRIPTION OF THE PREFERRED EMBODIMENTS

Figure 1A:
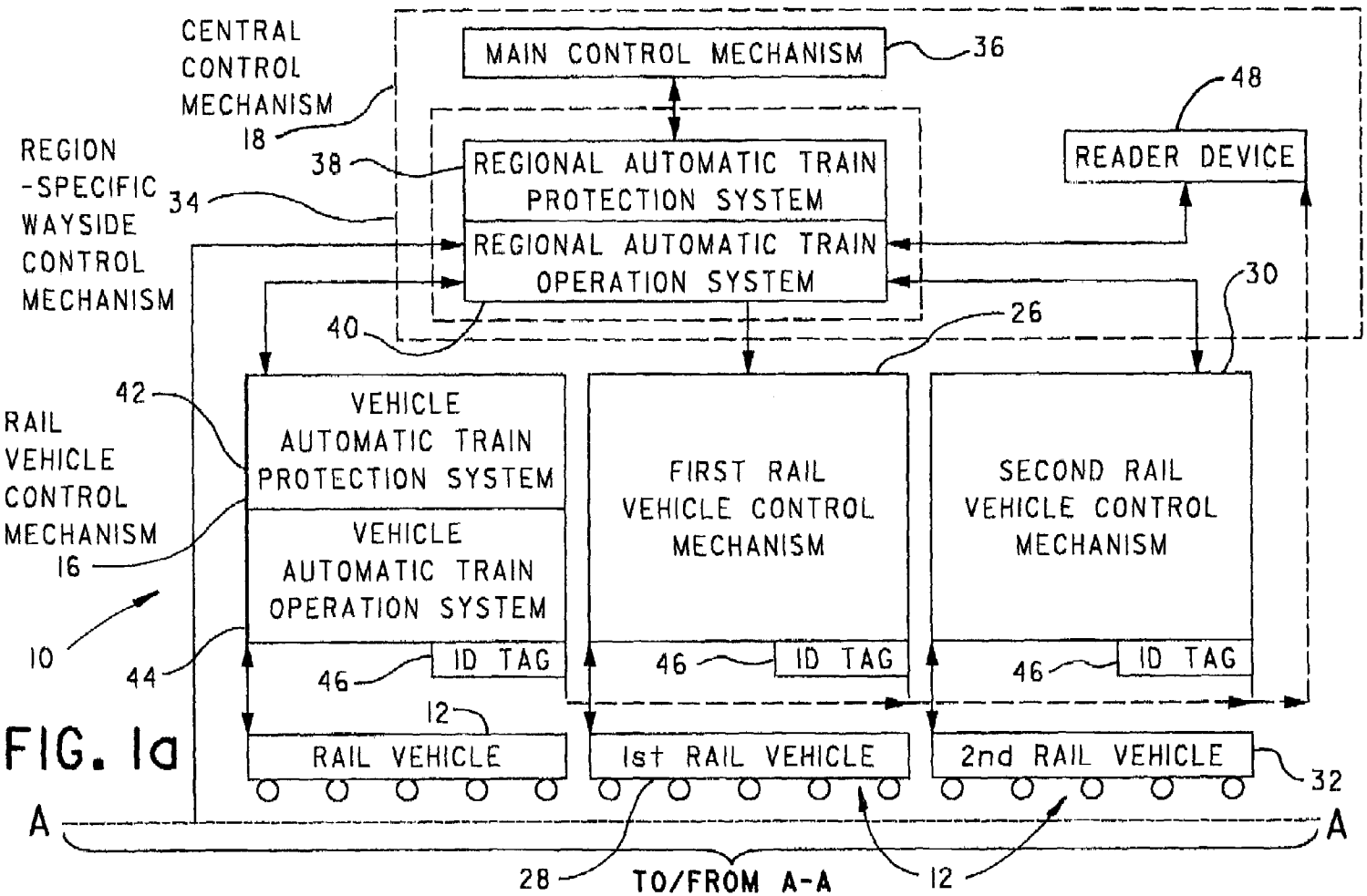
FIGS. 1*a* and 1*b* are schematic views of an automated manipulation system for a system according to the present invention.

For purposes of the description hereinafter, they terms "upper", "lower", "right", "left", "vertical", "horizontal", "top", "bottom" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 1B:
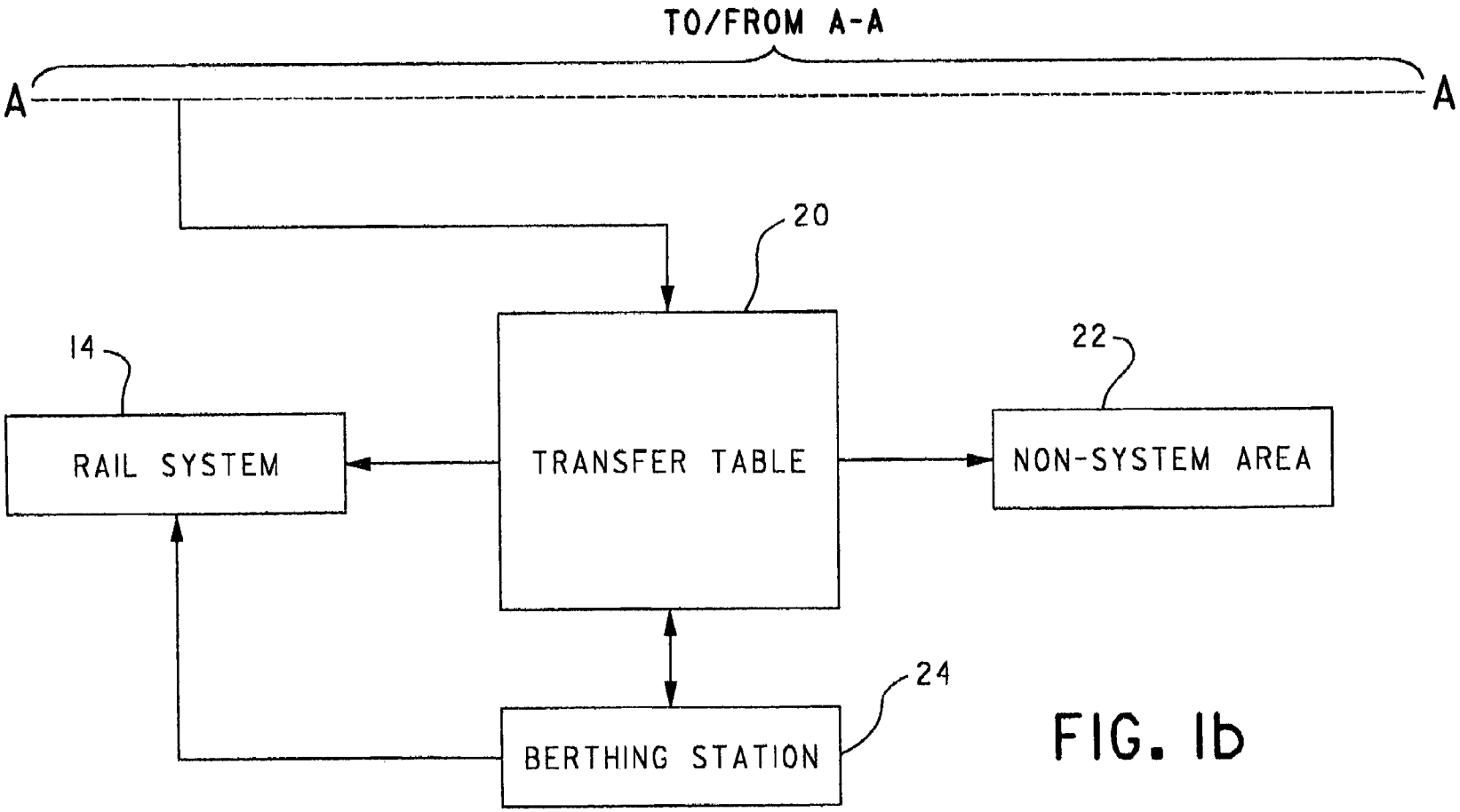
Figure 2A:
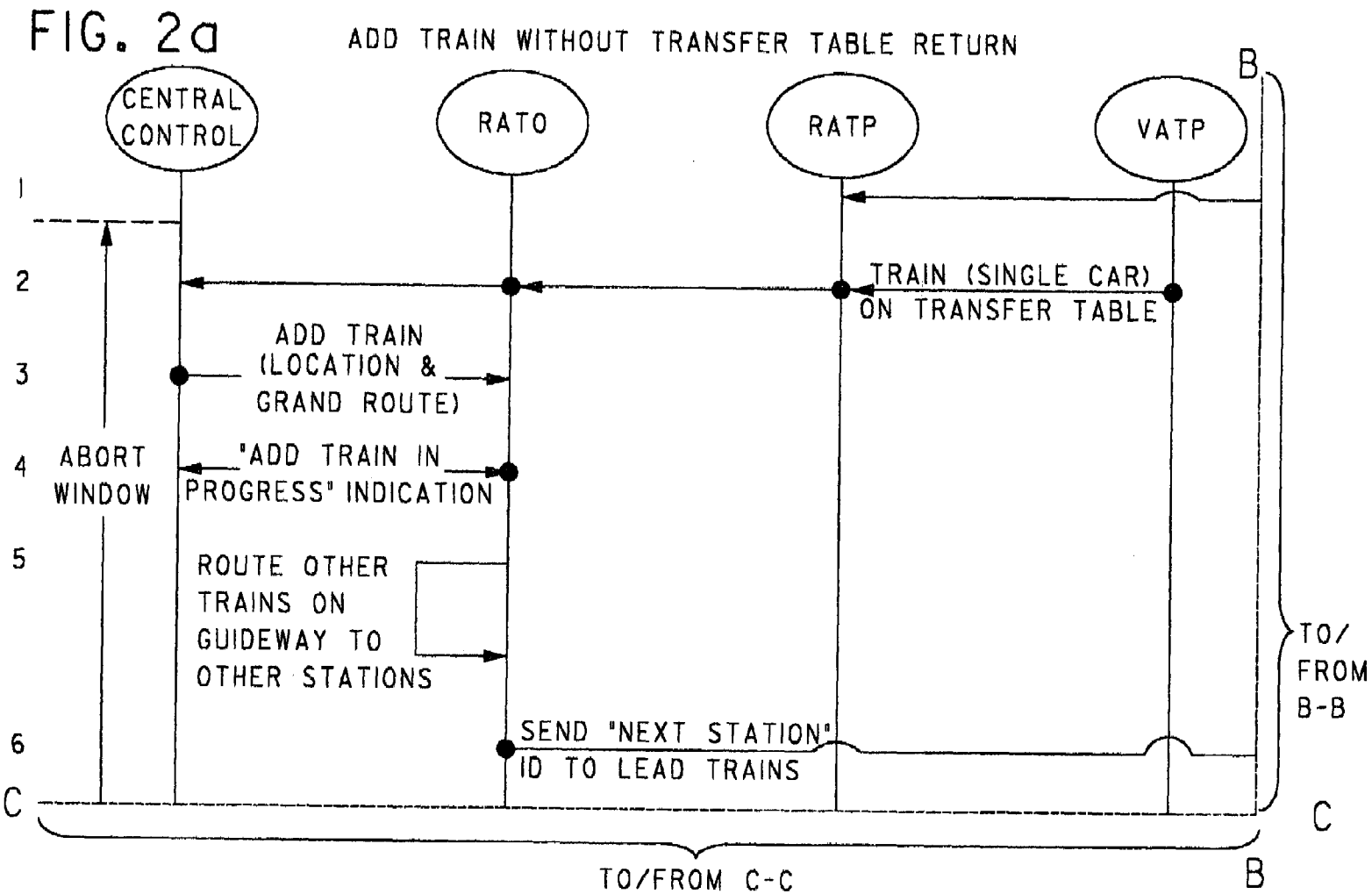
FIGS. 2*a*–2*d* are schematic flow diagrams illustrating a preferred embodiment directed to the addition of a vehicle without a transfer table retum in an automated manipulation system according to the present invention.
Figure 2B:
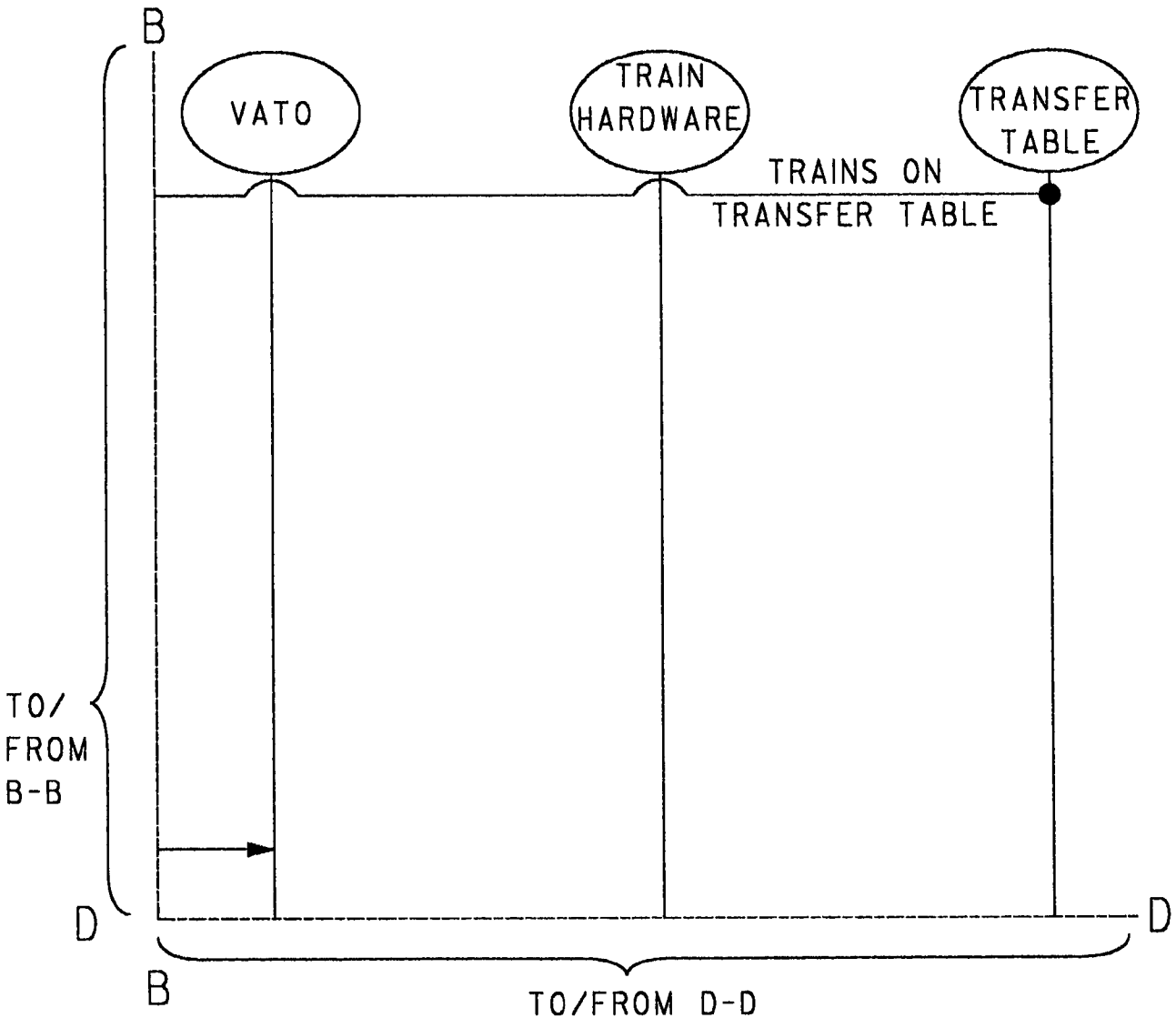
Figure 2C:
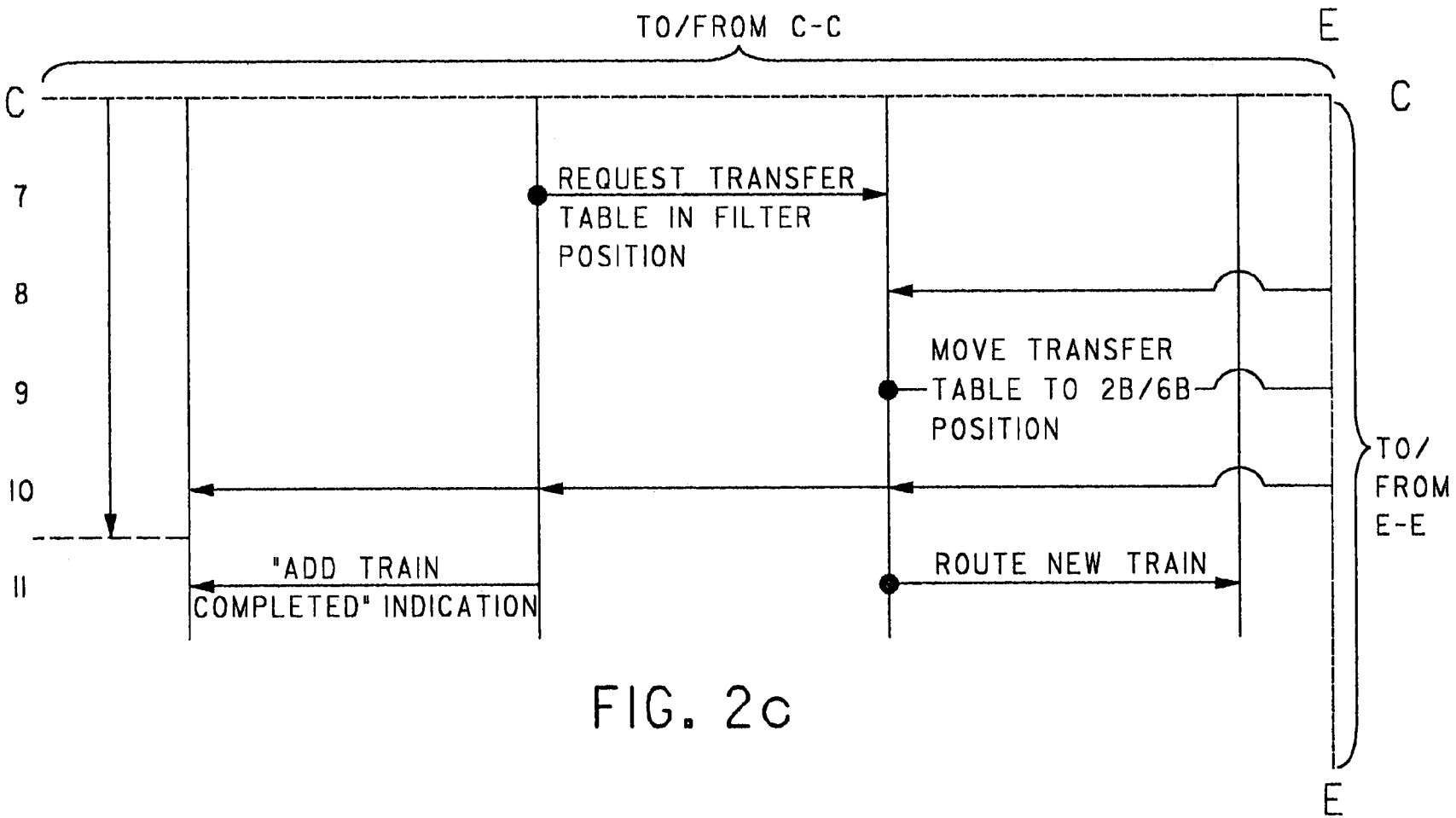
Figure 2D:
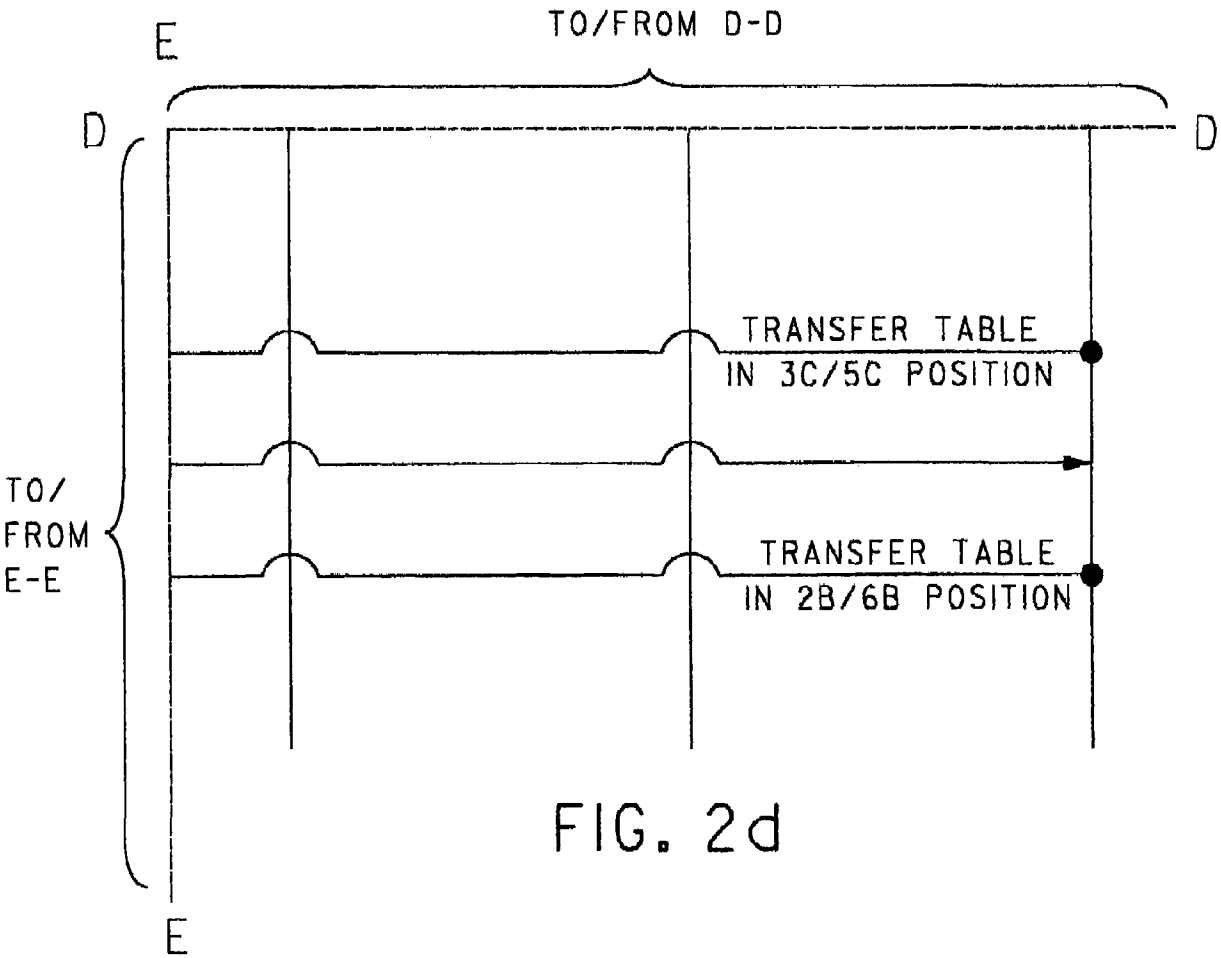
Figure 3A:
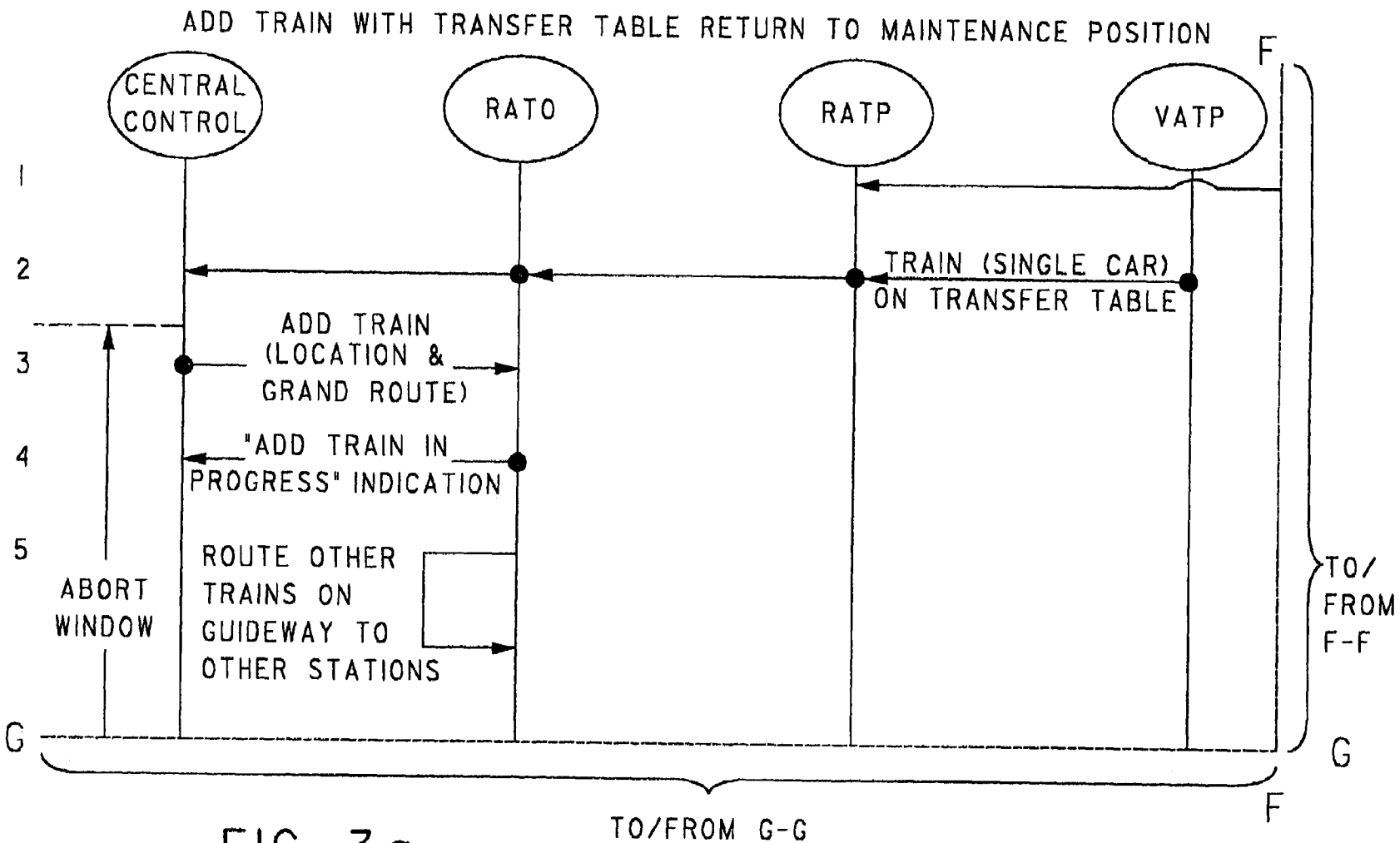
FIGS. 3*a*–3*f* are schematic flow diagrams illustrating a preferred embodiment directed to the addition of a vehicle with a transfer table returned to a maintenance position according to the present invention.
Figure 3B:
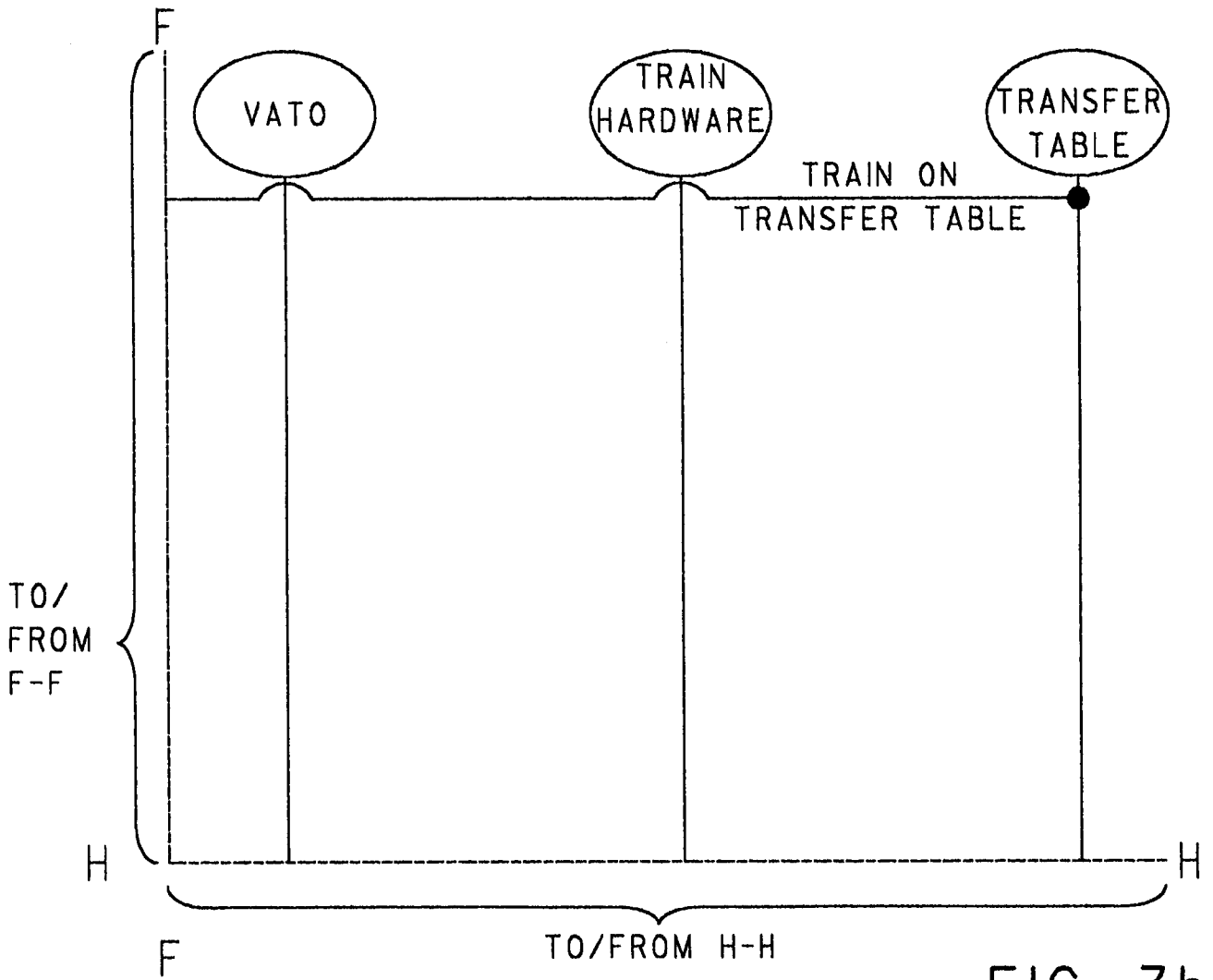
Figure 3C:
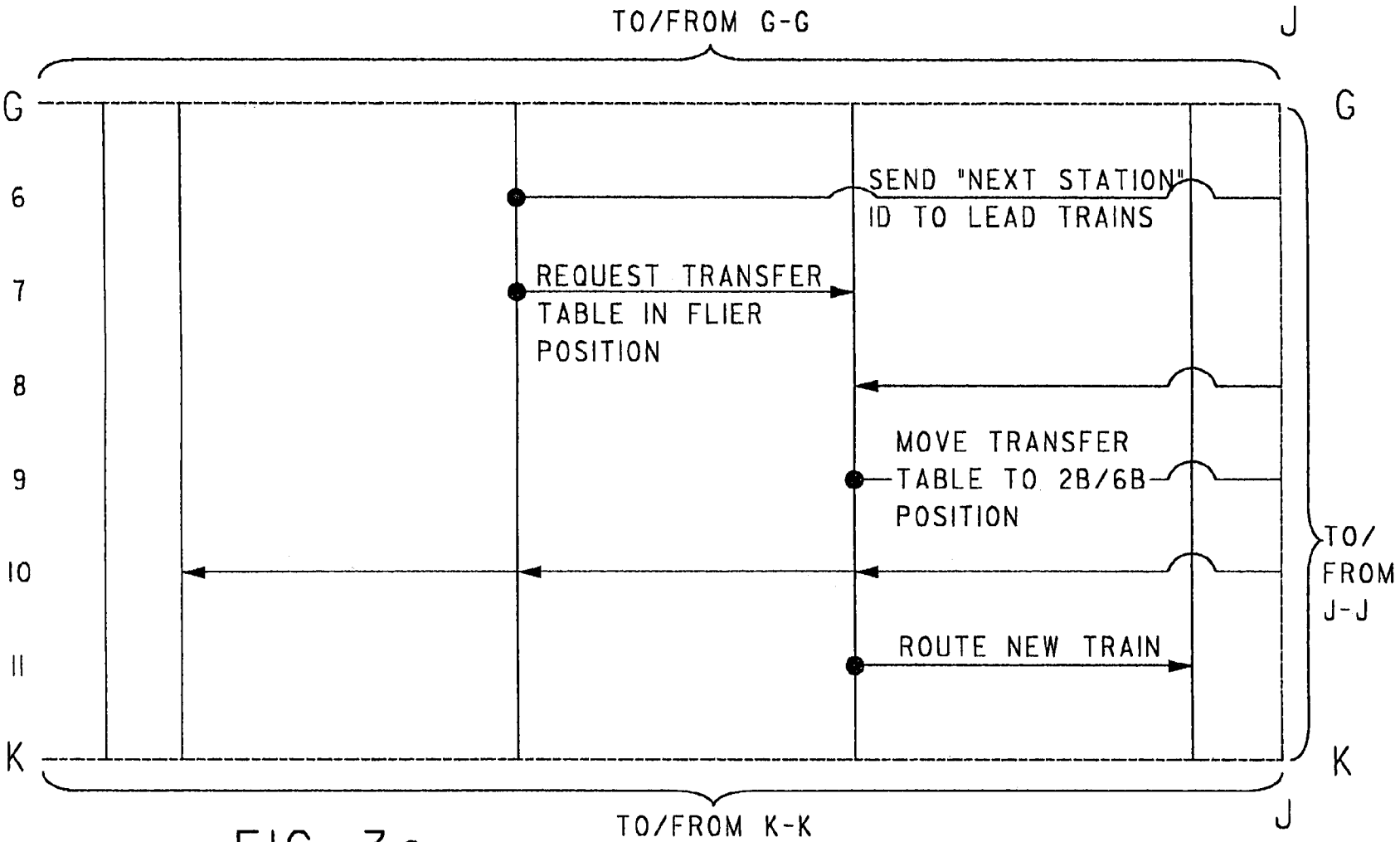
Figure 3D:
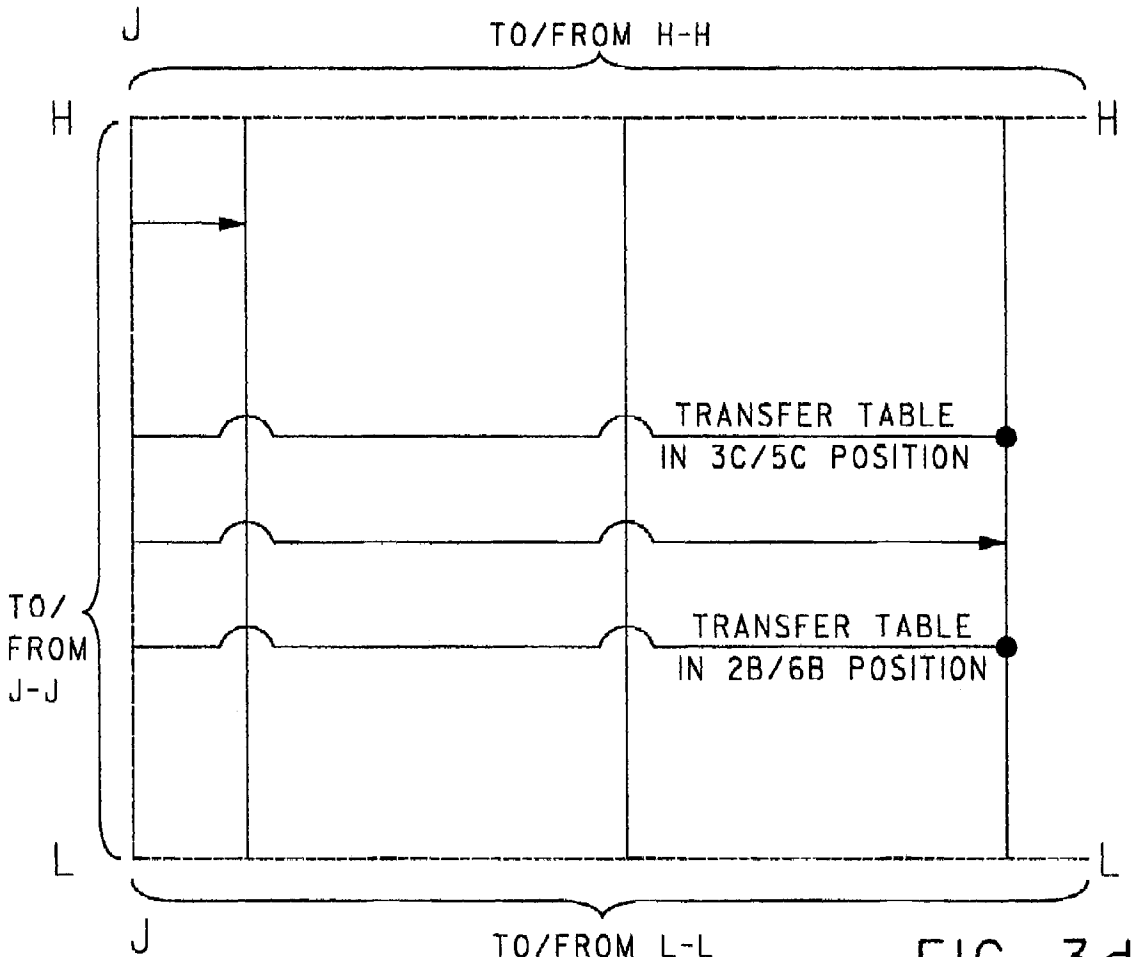
Figure 3E:
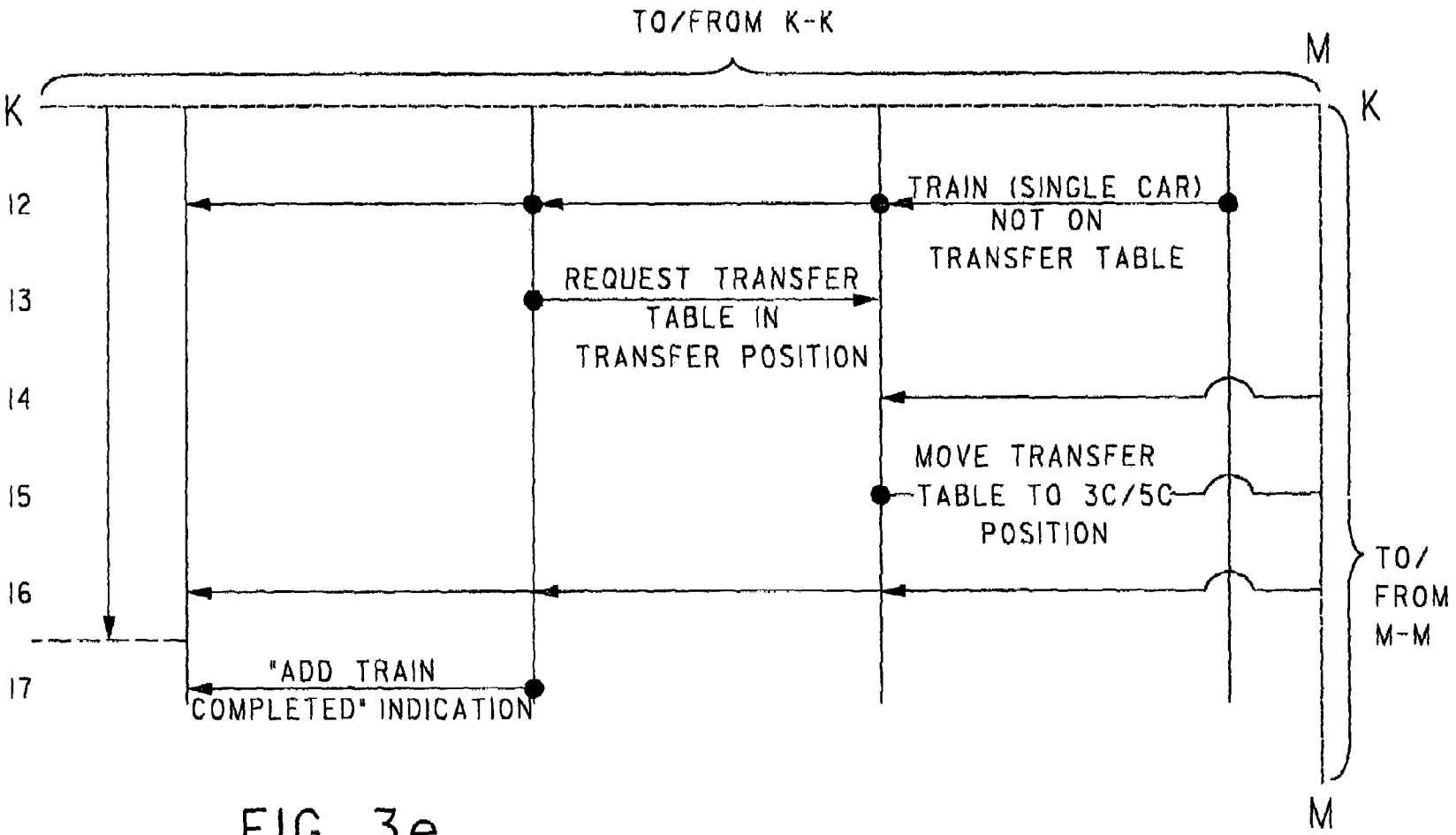
Figure 3F:
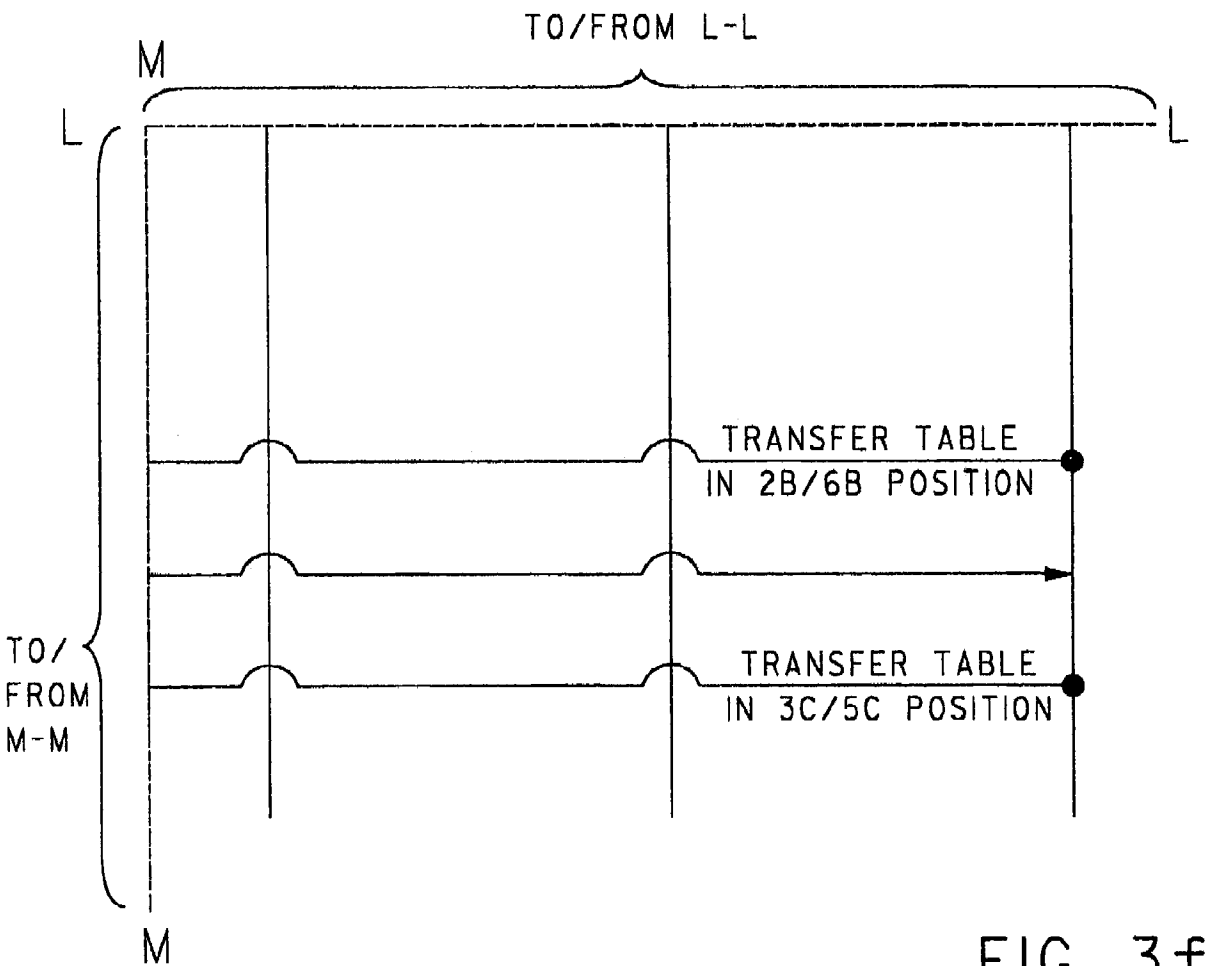
Figure 4A:
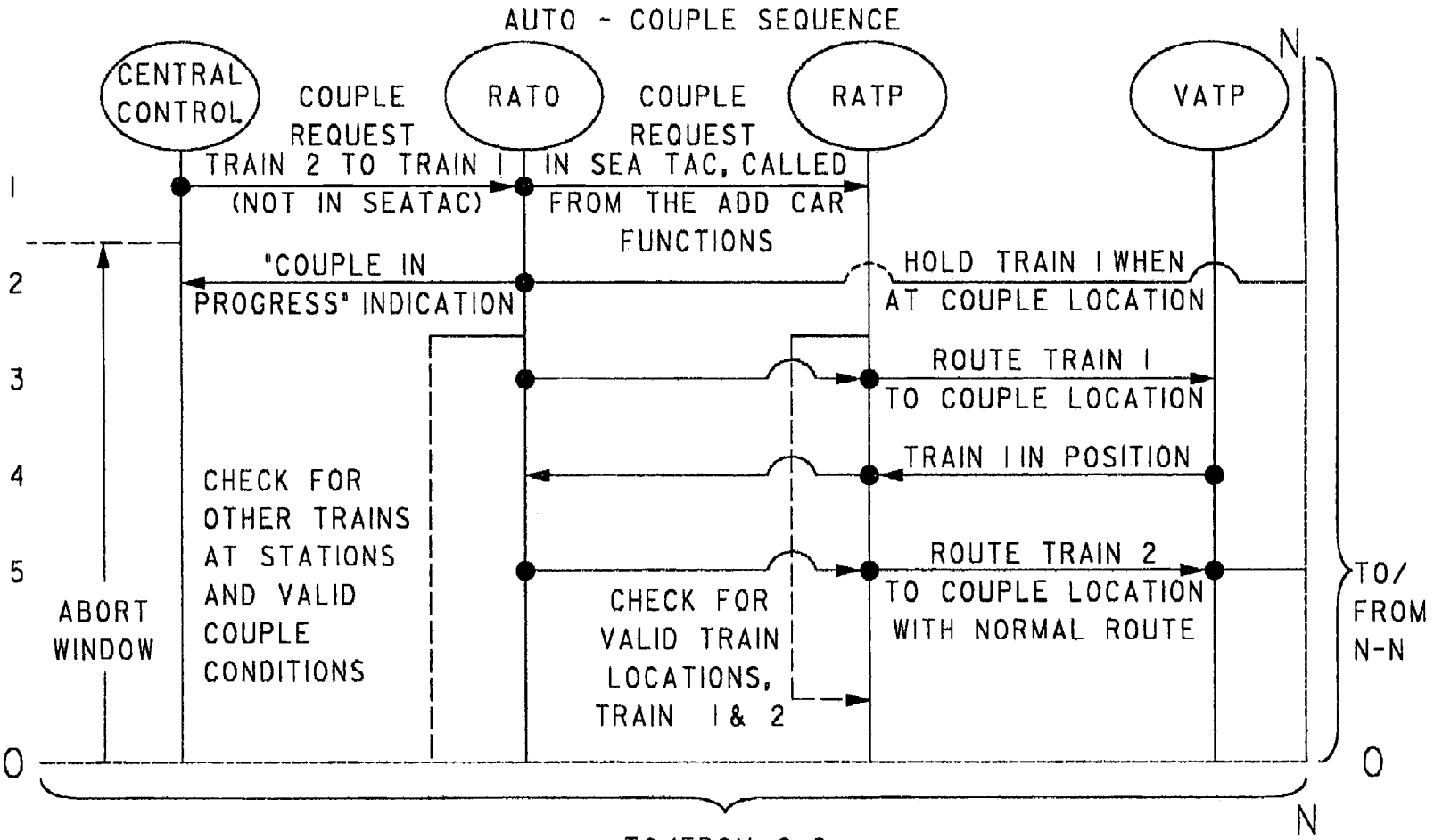
FIGS. 4*a*–4*f* are schematic flow diagrams illustrating a preferred embodiment directed to an auto-couple sequence of a vehicle in an automated manipulation system according to the present invention.
Figure 4B:
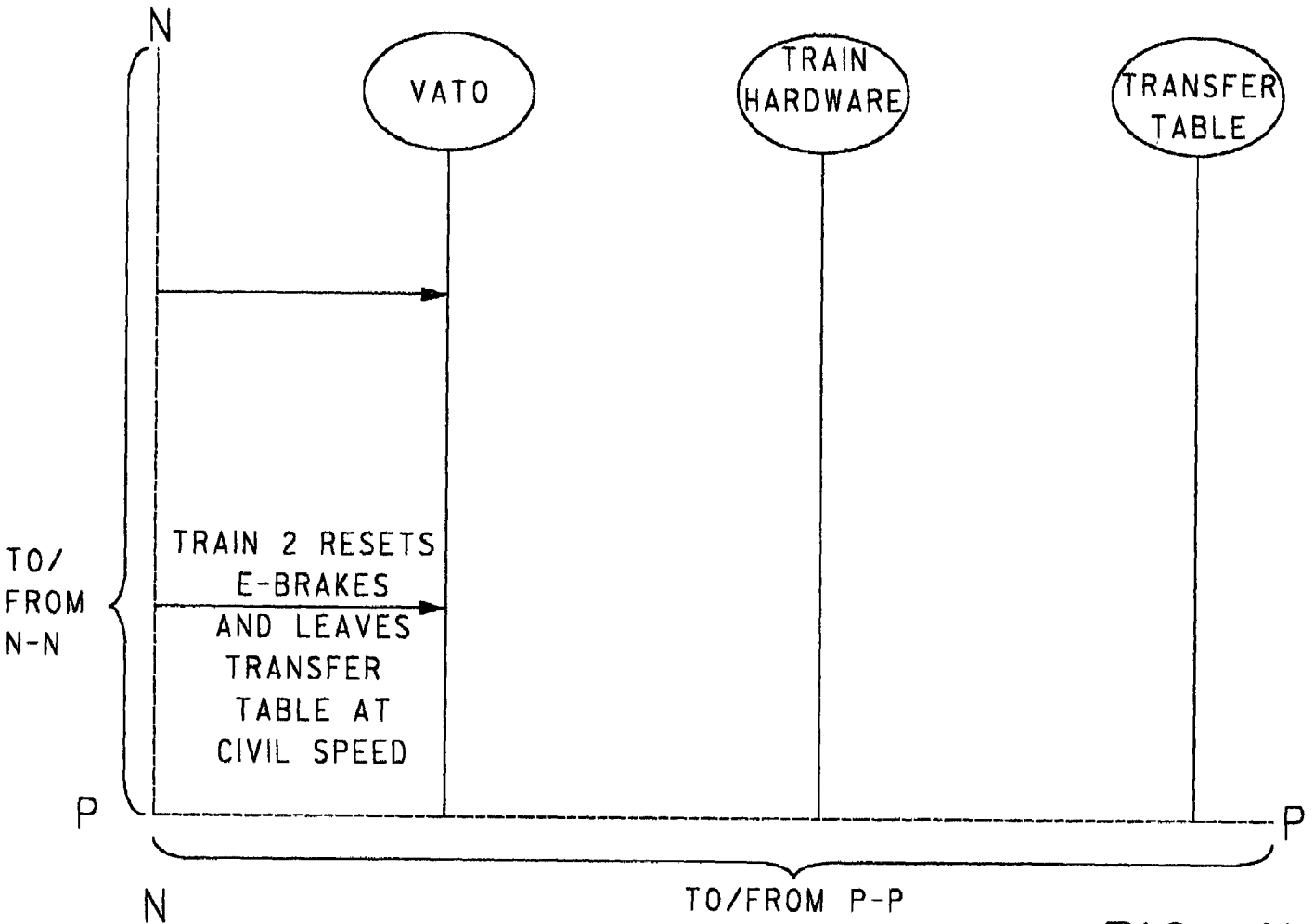
Figure 4C:
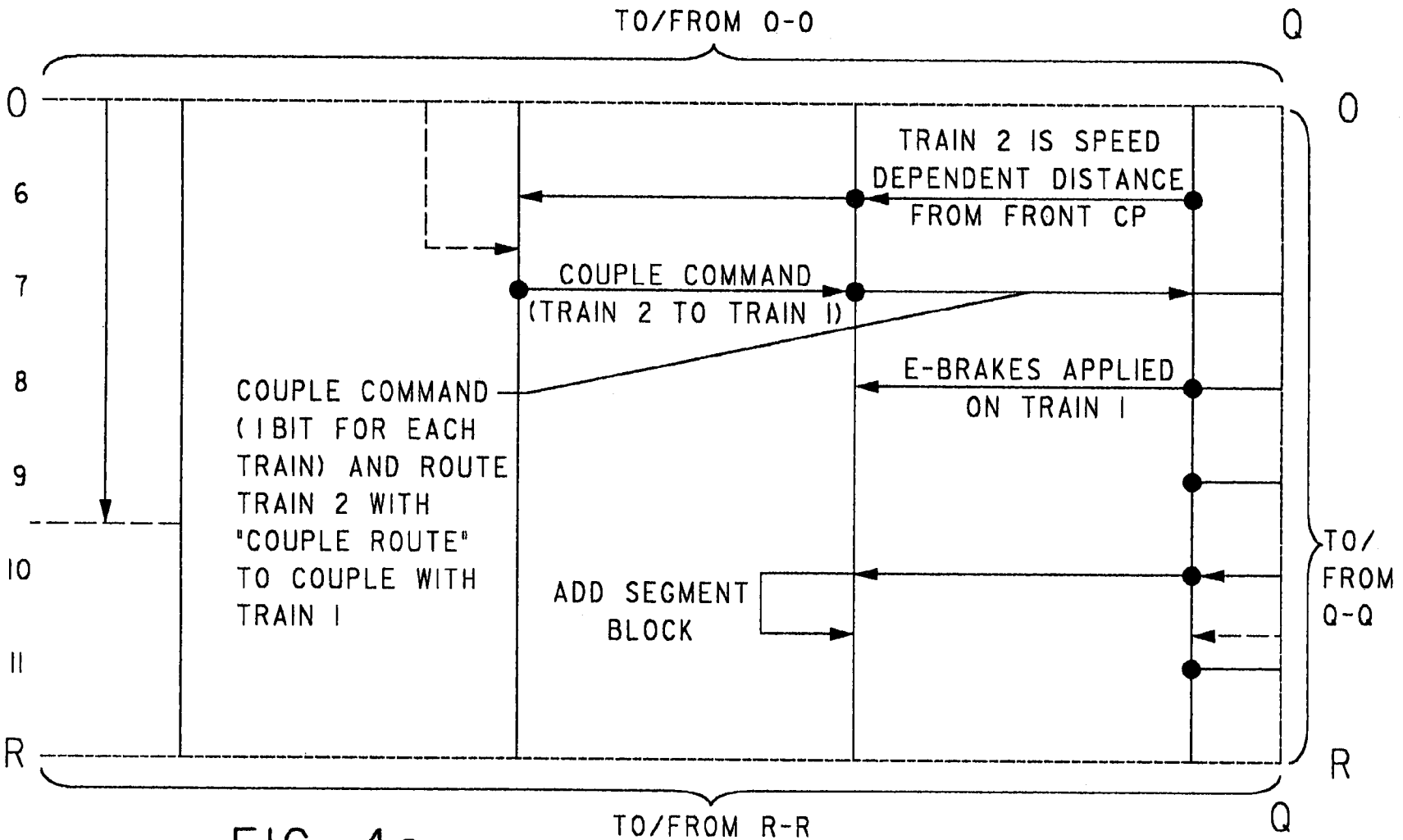
Figure 4D:
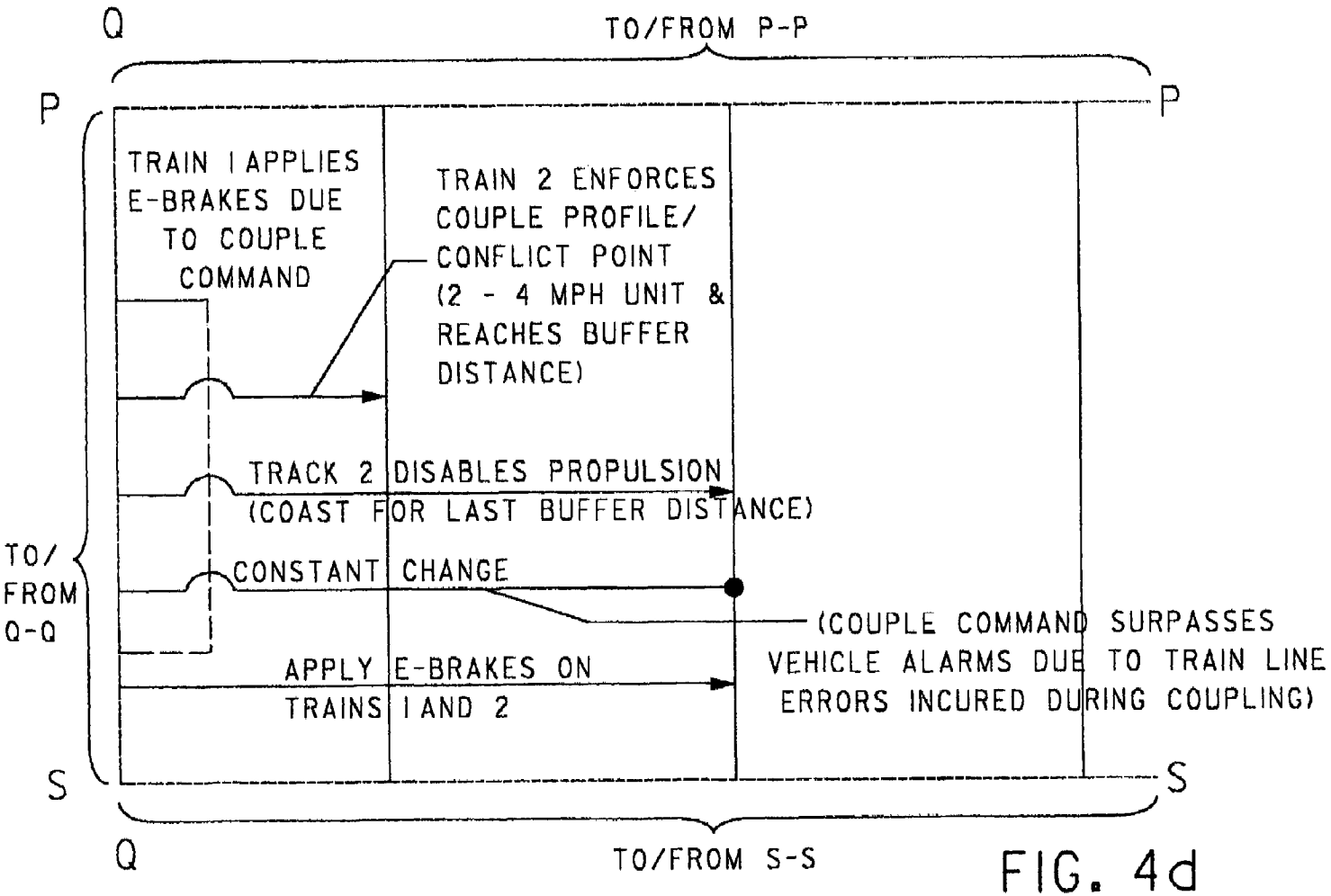
Figure 4E:
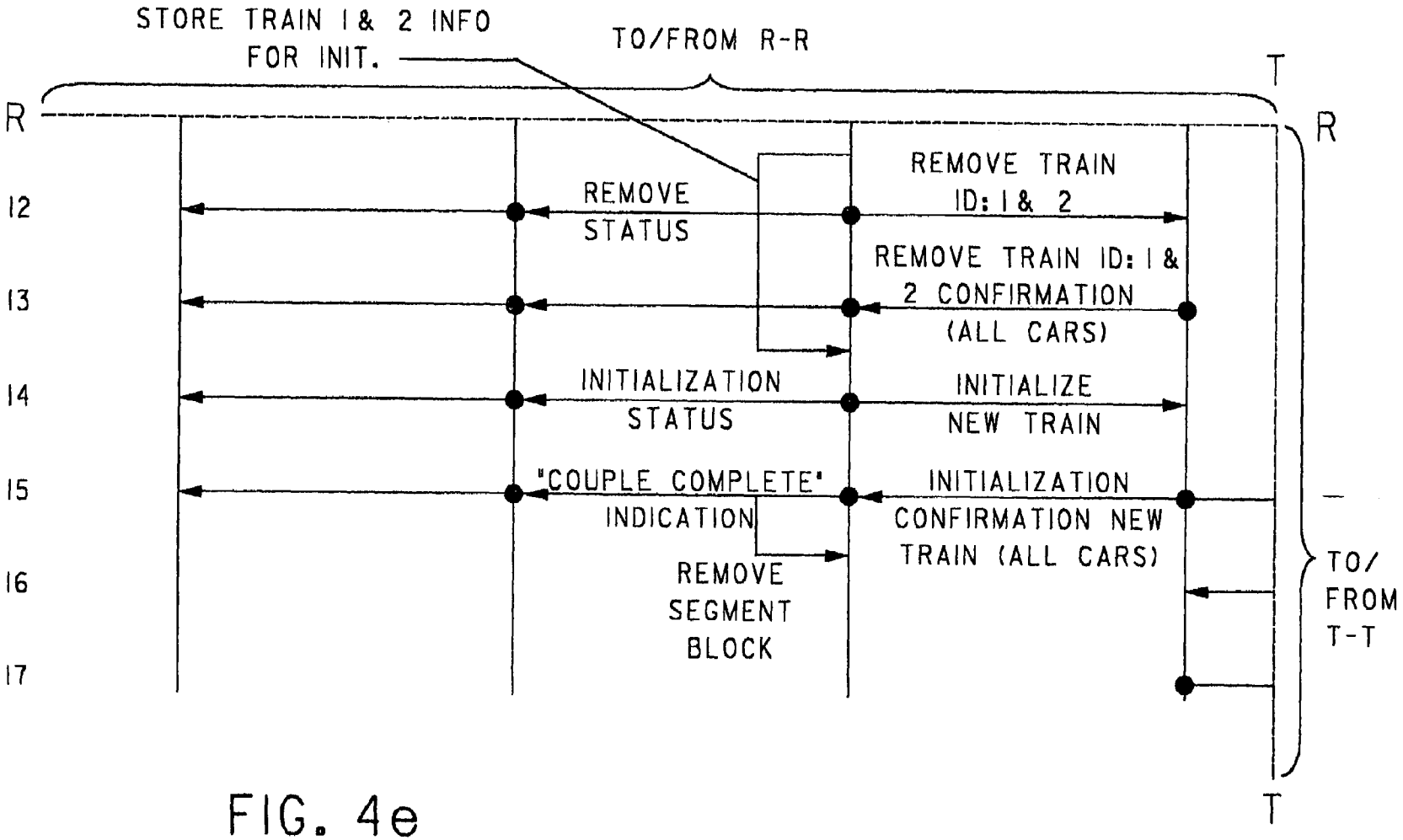
Figure 4F:
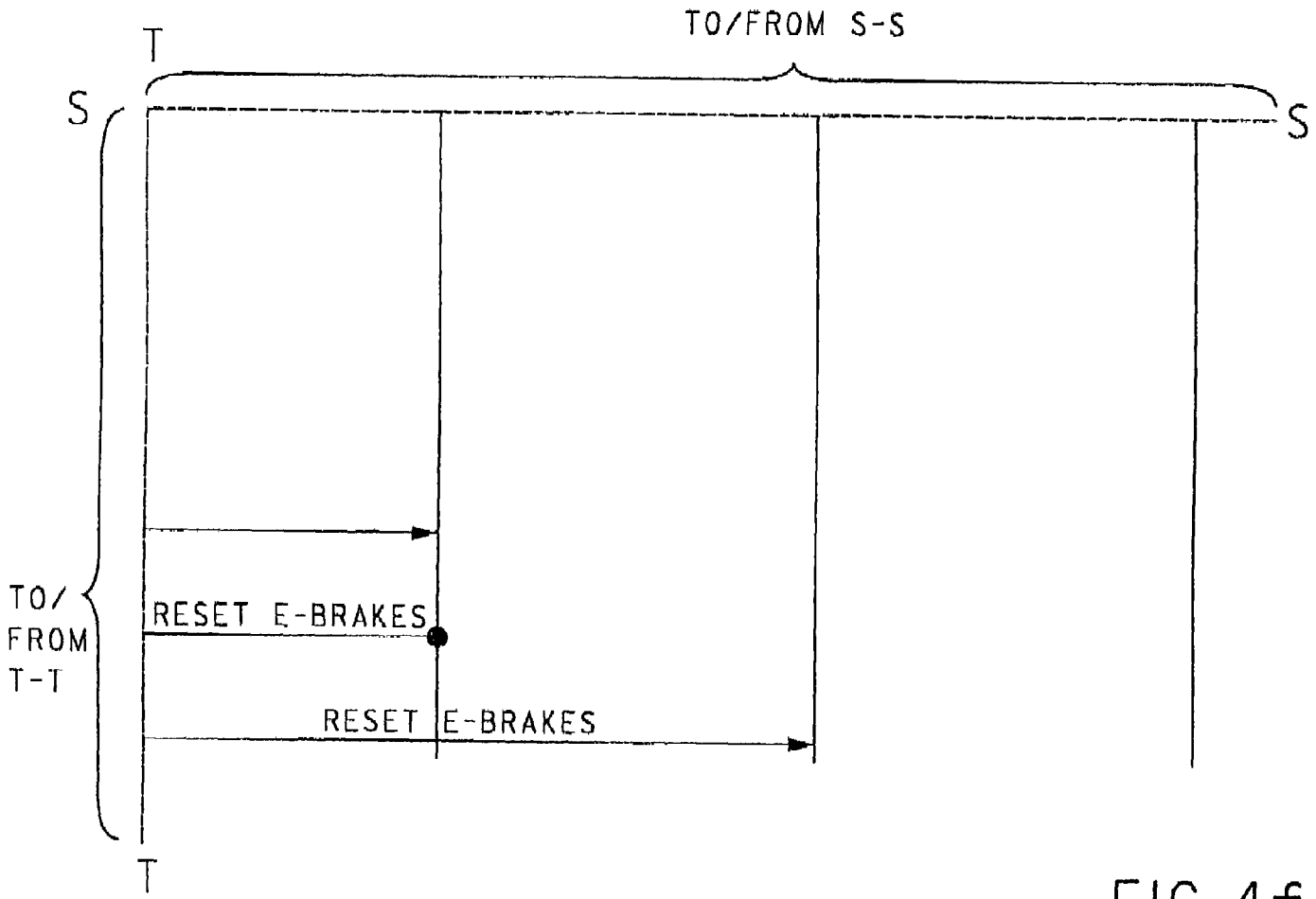
Figure 5A:
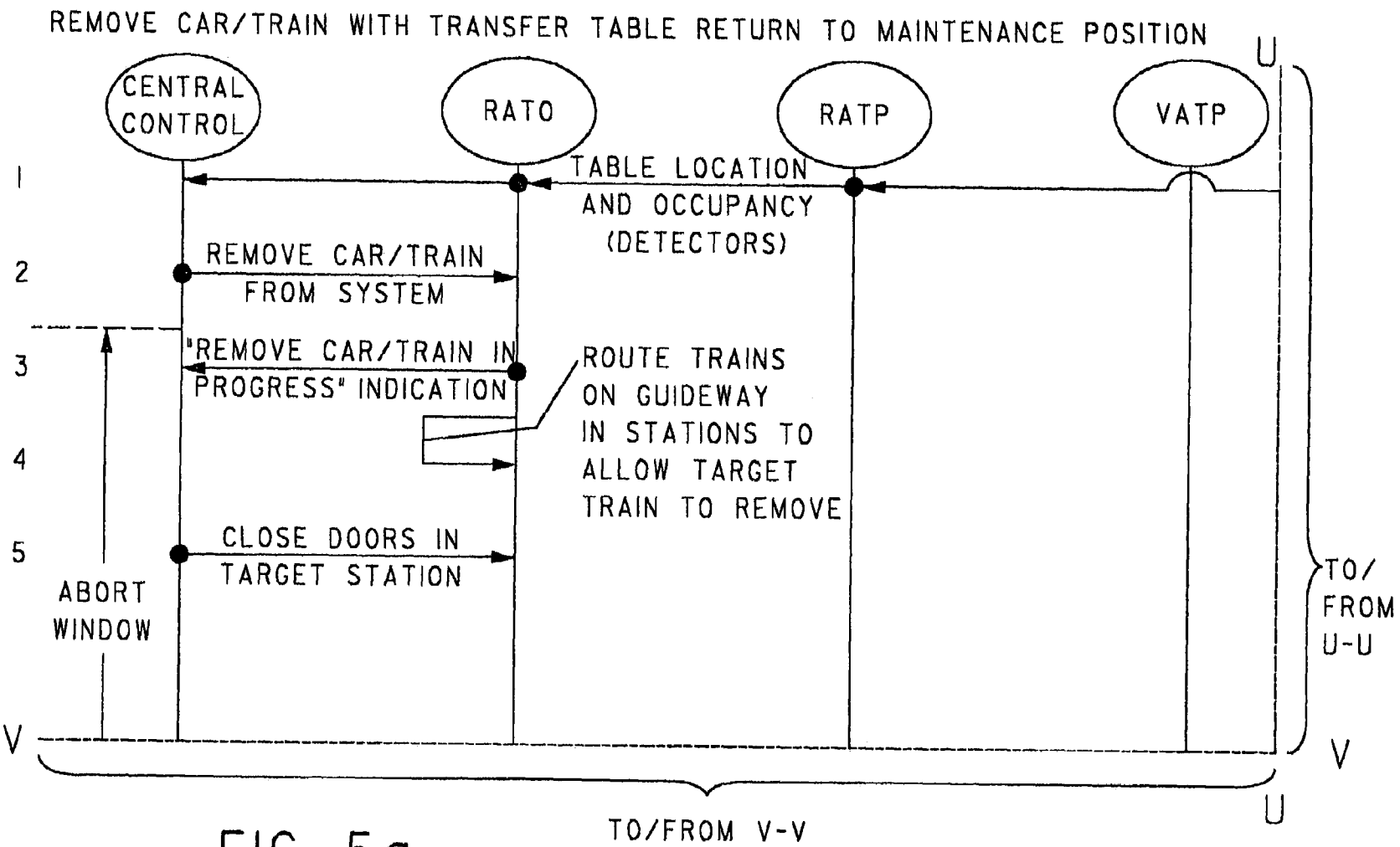
FIGS. 5*a*–5*f* are schematic flow diagrams illustrating a preferred embodiment directed to the removal of a vehicle with a transfer table return to a maintenance position according to the present invention.
Figure 5B:
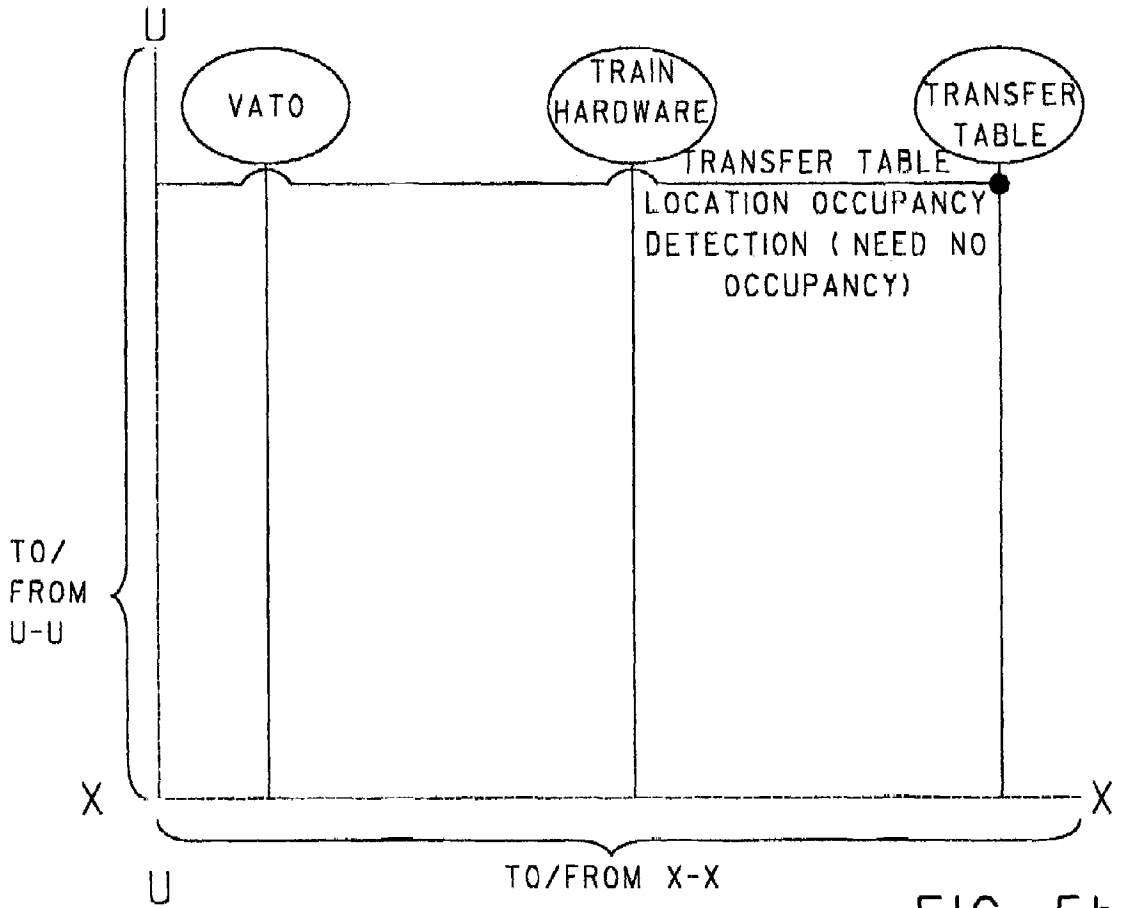
Figure 5C:
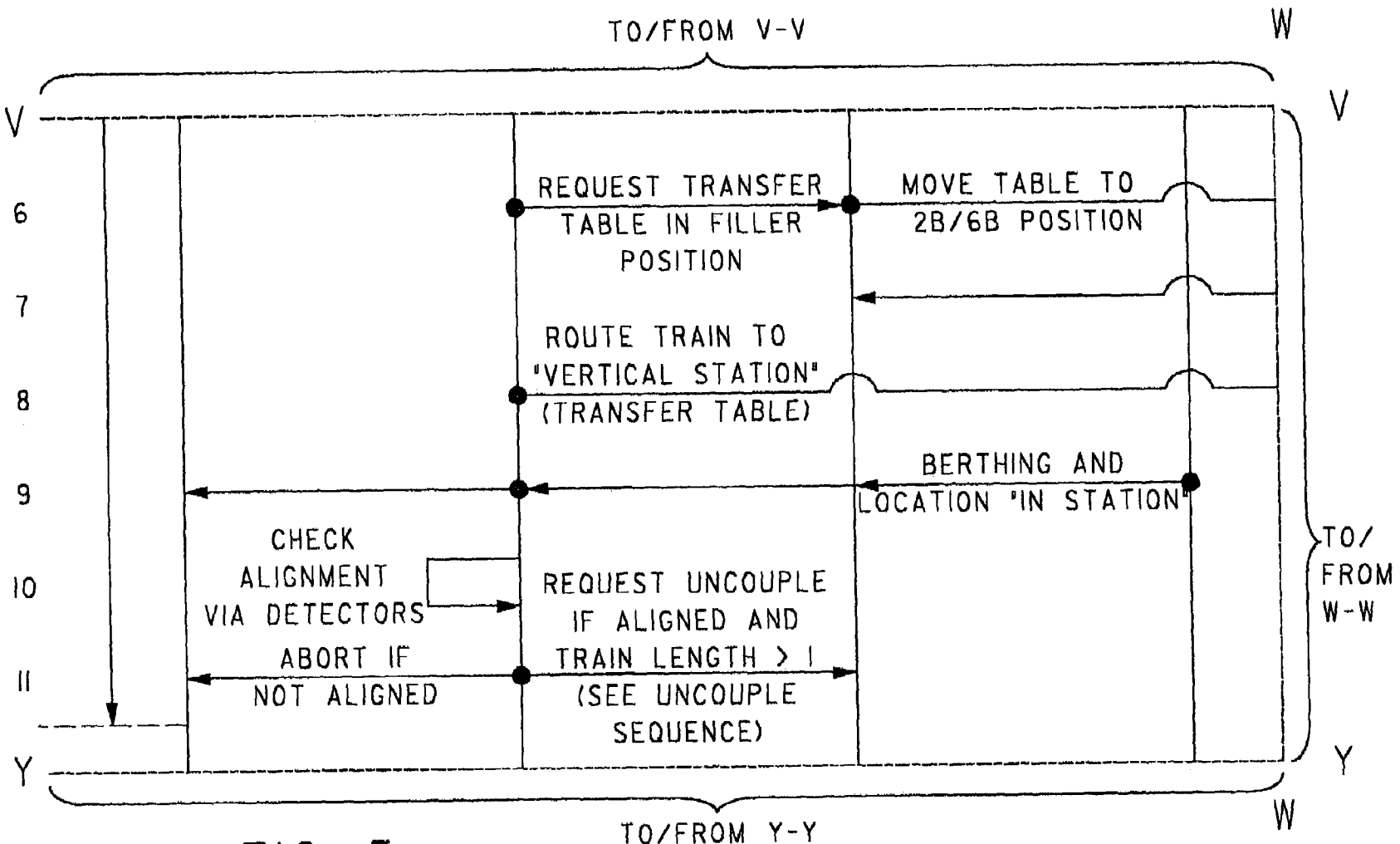
Figure 5D:
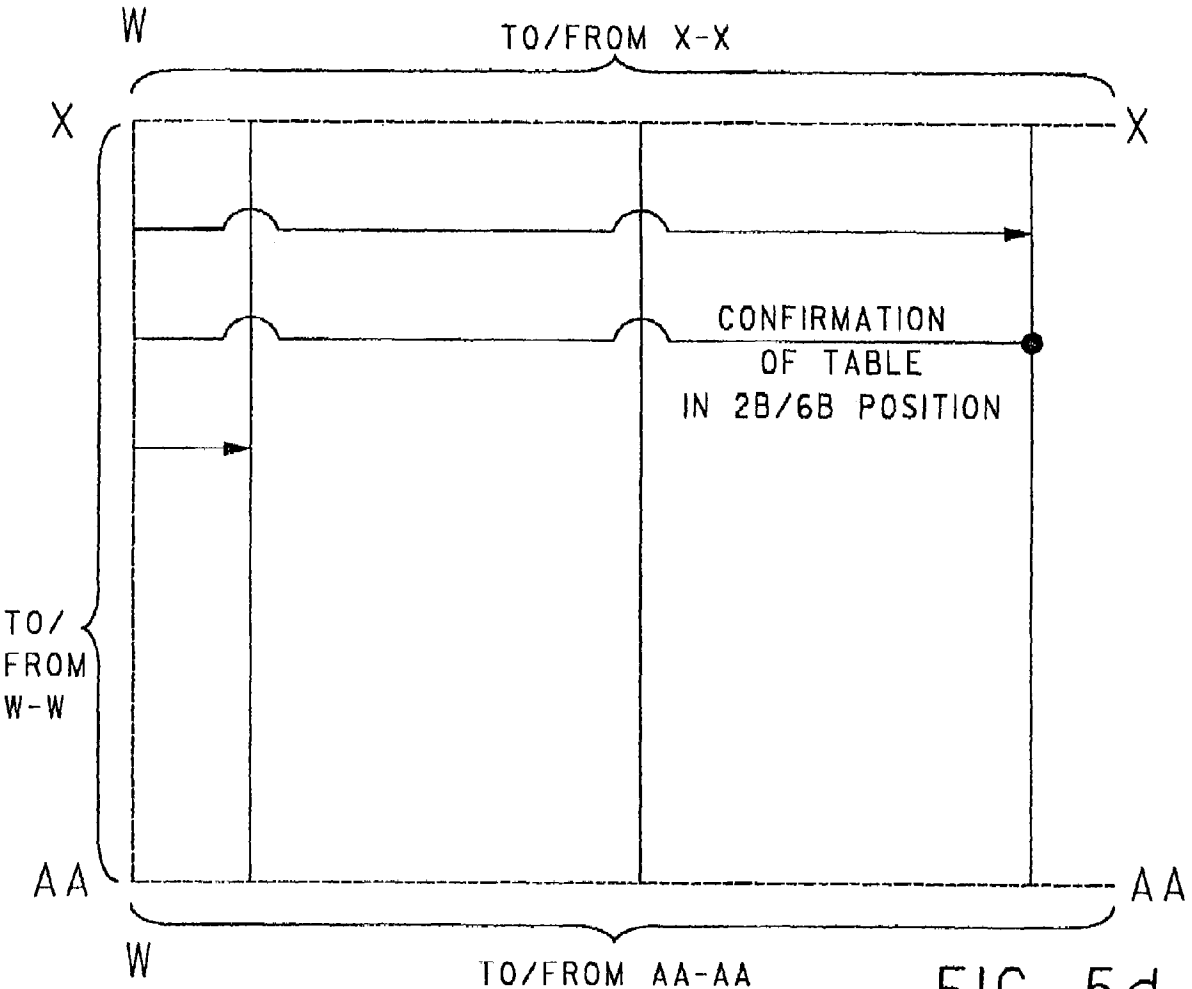
Figure 5E:
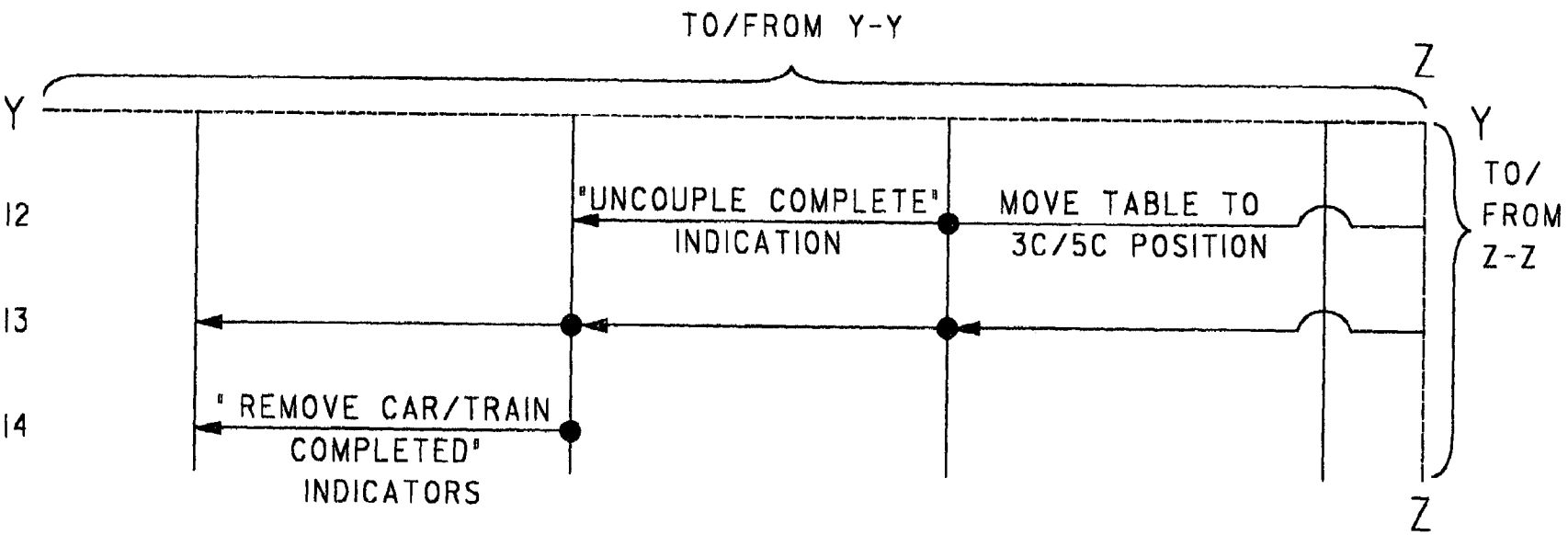
Figure 5F:
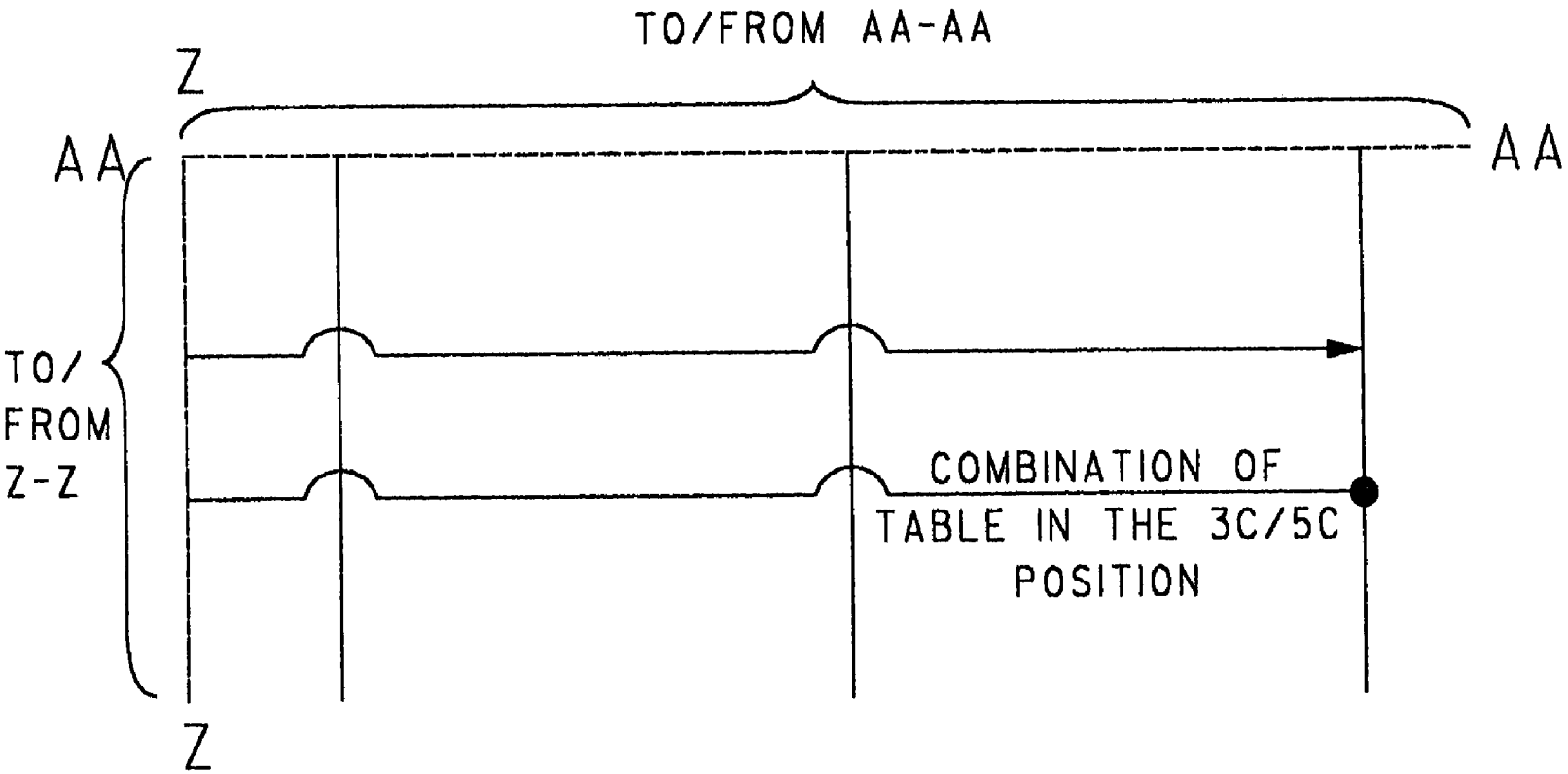
Figure 6A:
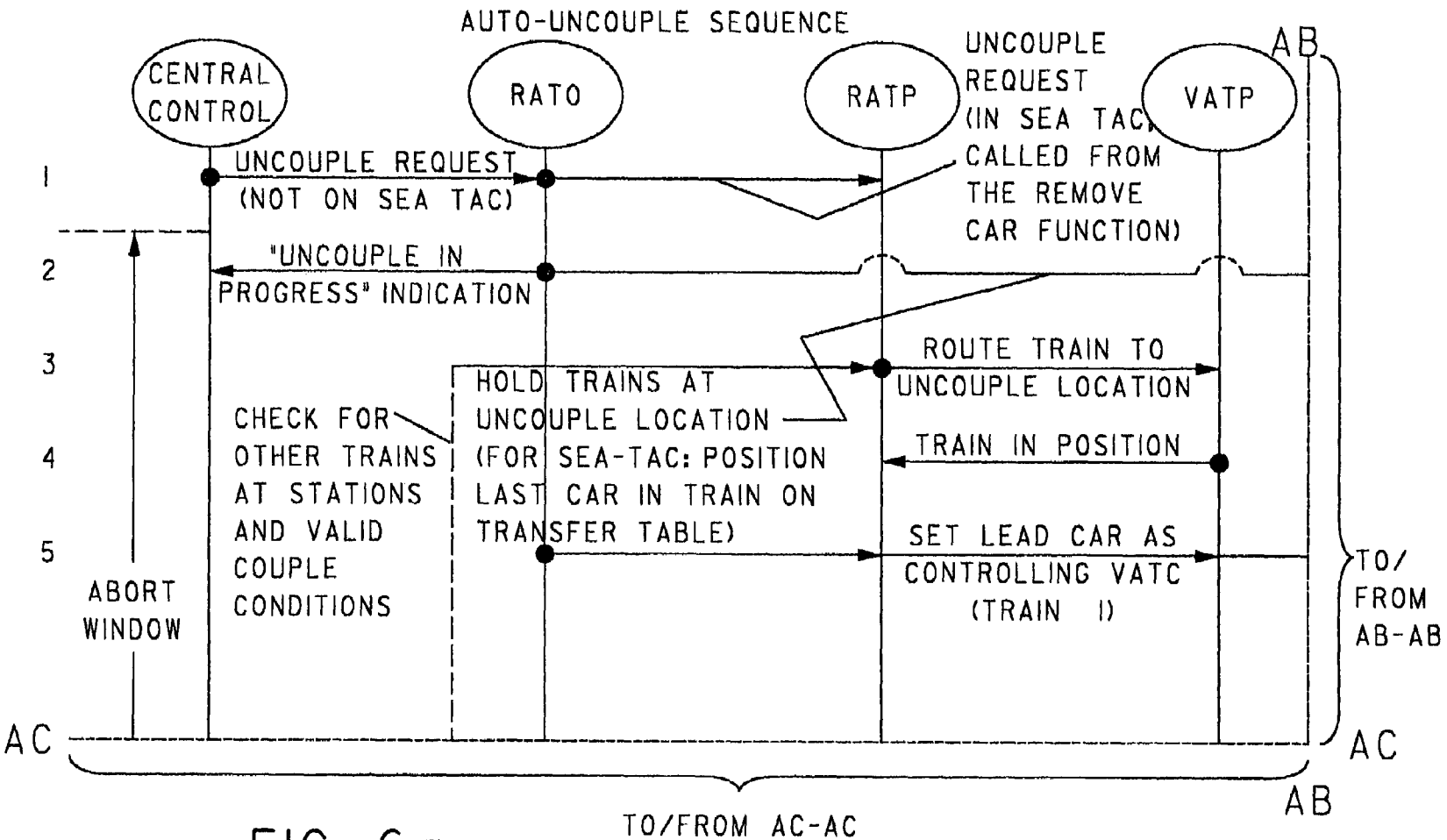
FIGS. 6*a*–6*f* are schematic flow diagrams illustrating a preferred embodiment directed to an auto-uncouple sequence of a vehicle in an automated manipulation system according to the present invention.
Figure 6B:
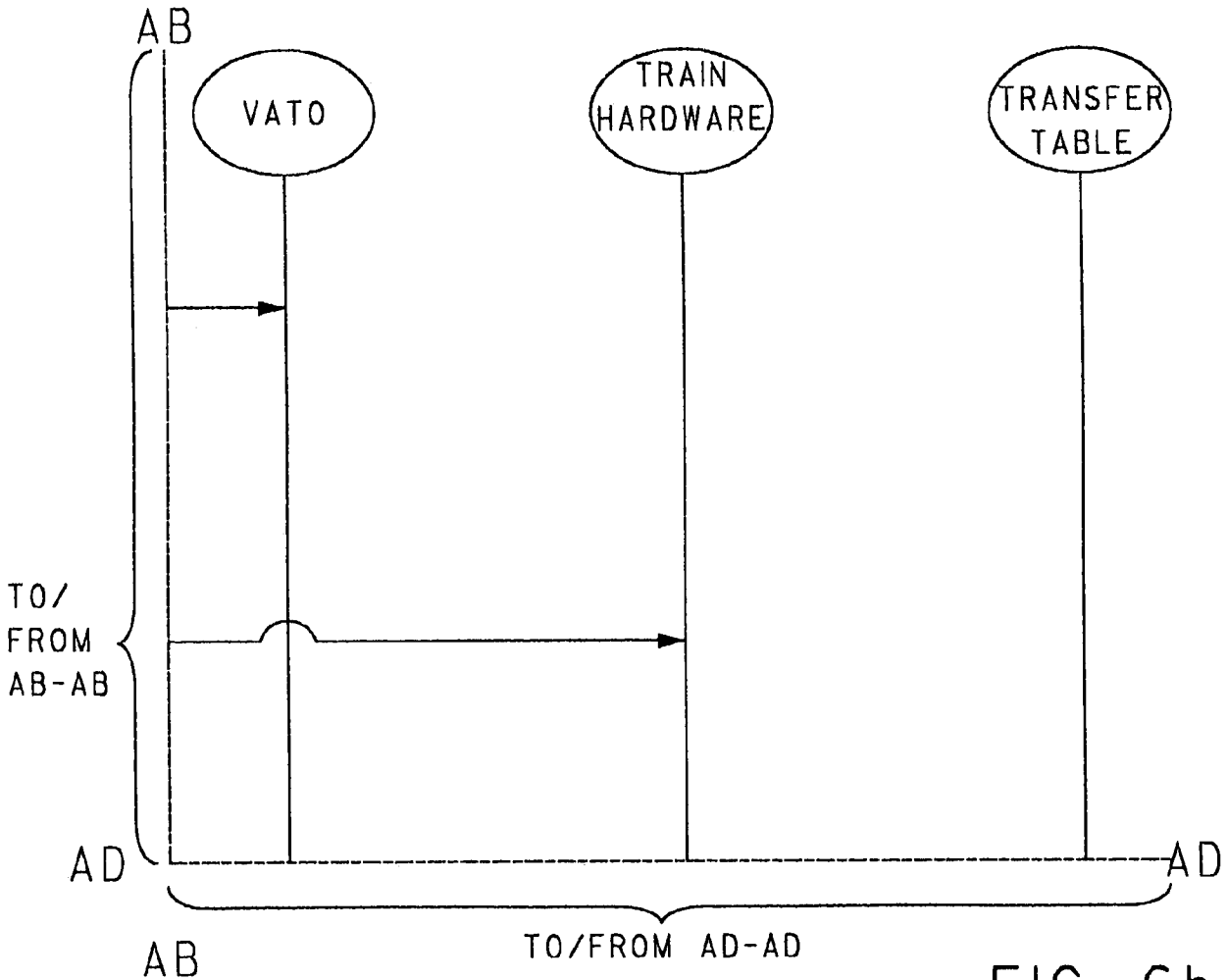
Figure 6C:
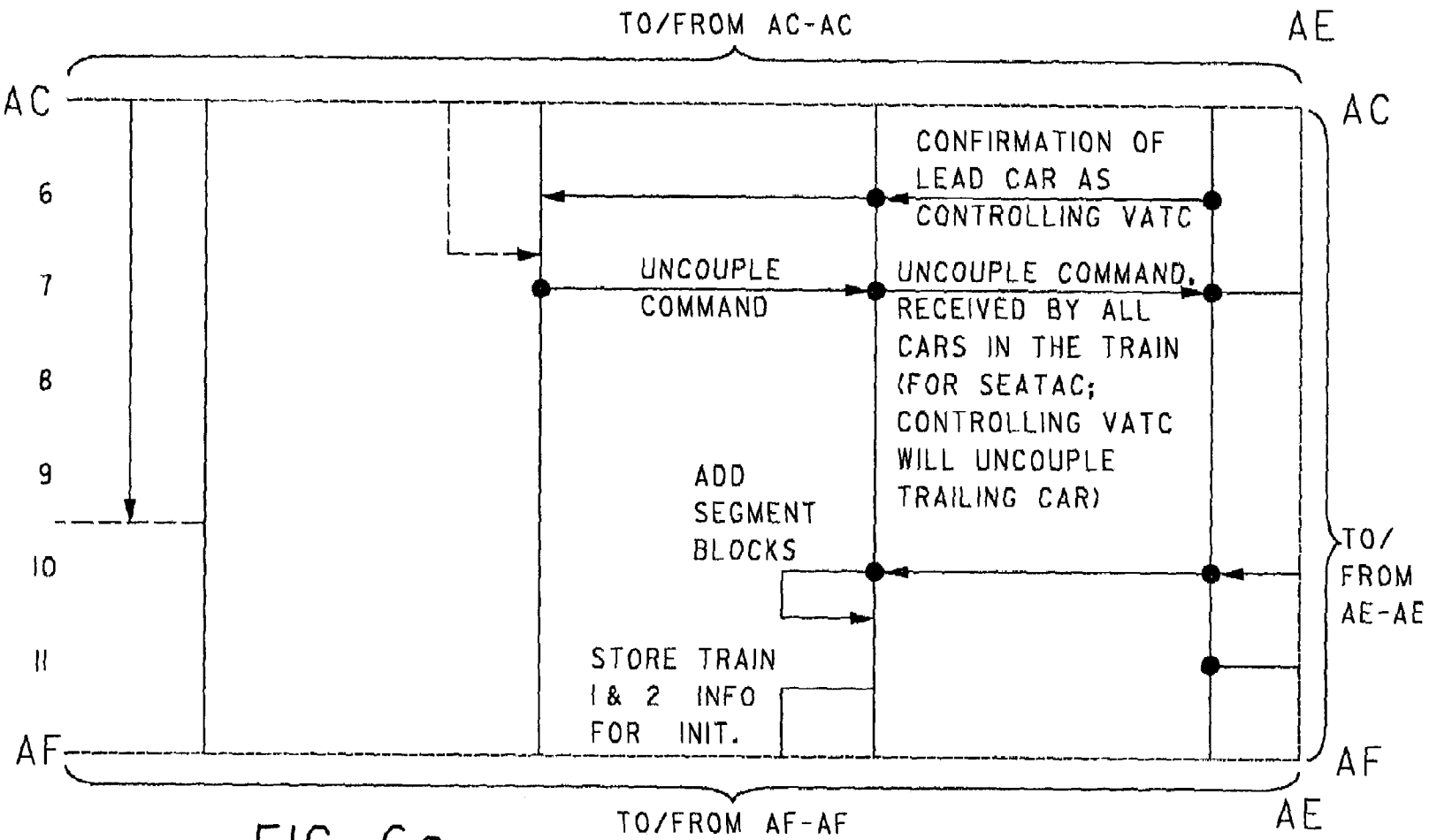
Figure 6D:
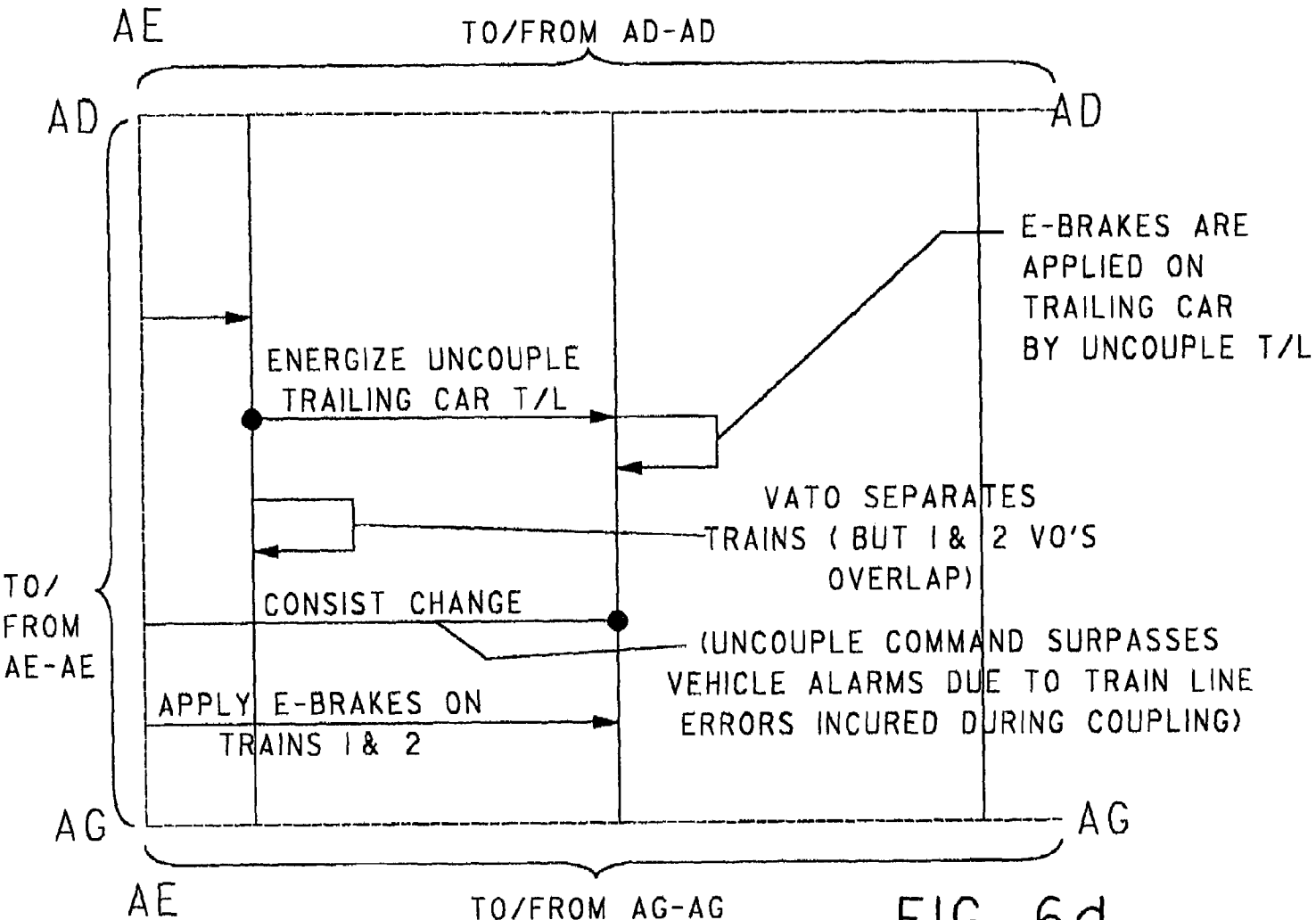
Figure 6E:
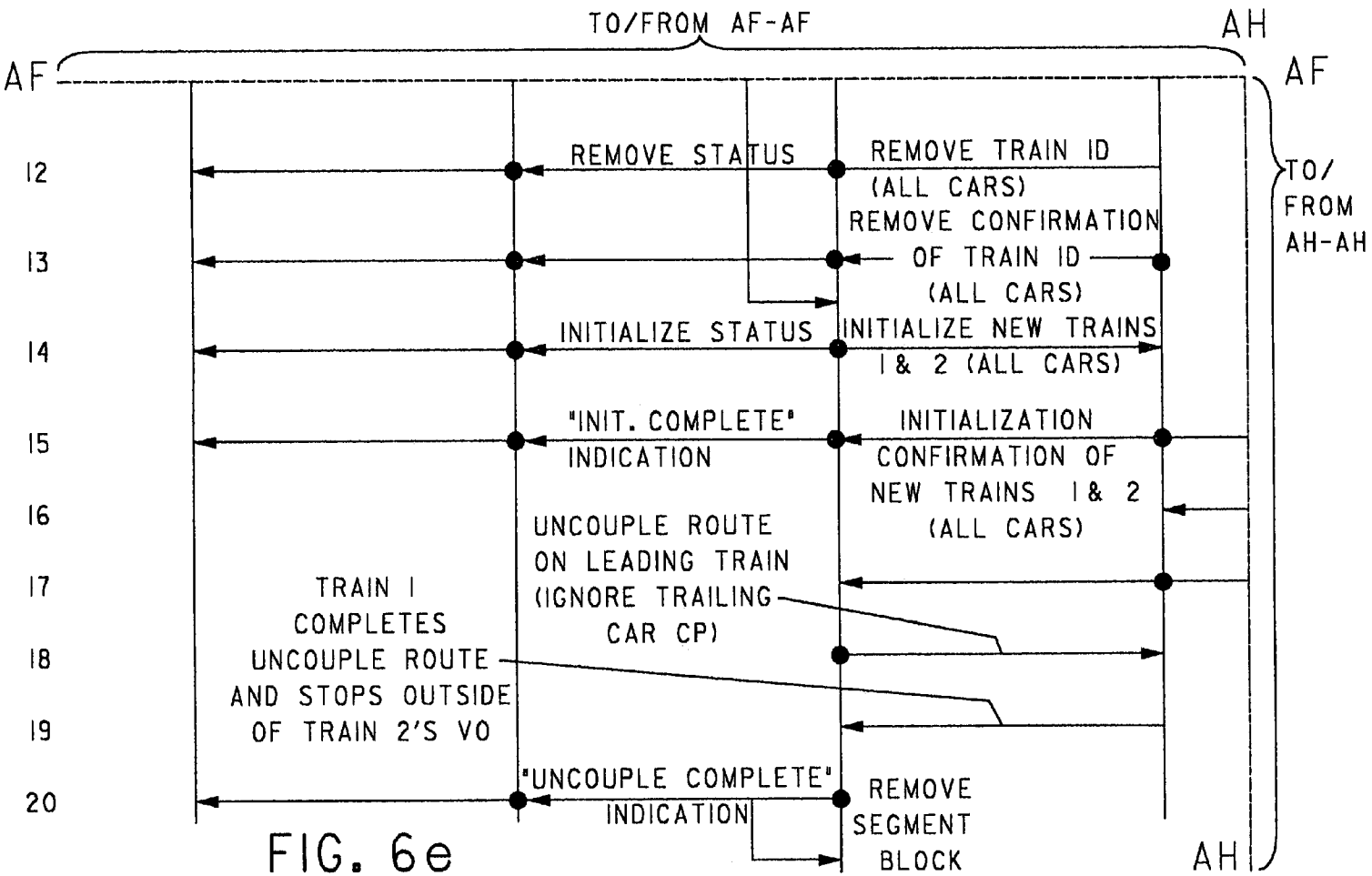
Figure 6F:
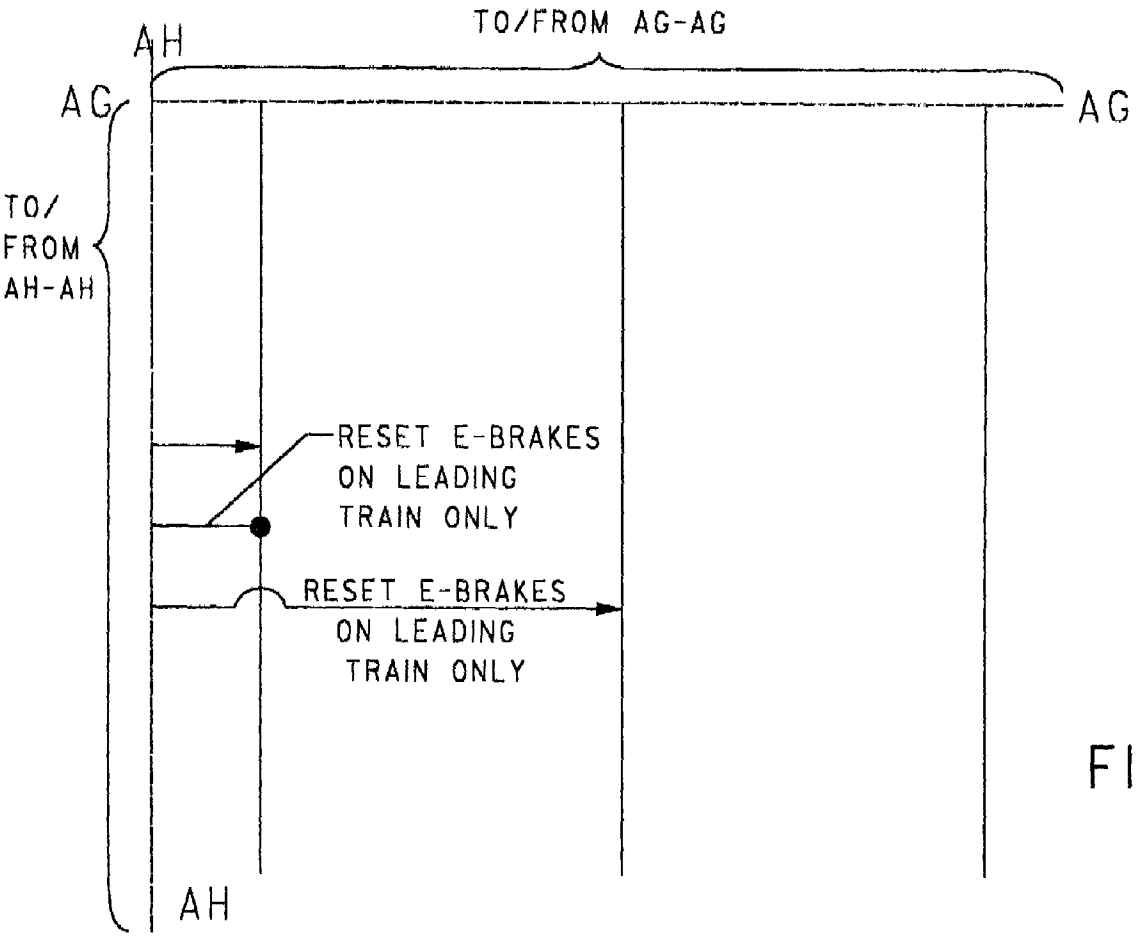

The present invention is an automated manipulation system 10, as illustrated in various preferred embodiments in the accompanying figures. As seen in FIGS. 1*a*–1*b* the manipulation system 10 is effective for manipulating at least one, and typically multiple, vehicles 12 in a transit system 14. For the purpose of description, the present invention will be described in connection with the vehicles 12 being rail vehicles and the transit system 14 being a rail system. However, the use of the word "rail" as an adjective herein is not to be construed as limiting the present invention. The manipulation system 10 includes a rail vehicle control mechanism 16, which is in communication with the rail vechiel 12 serves to receive, process and transmit signals for controlling the operation of the rail vehicle 12. The manipulation system 10 also includes a central control mechanism 18, which is in contactless or wireless communication with the rail vehicle control mechanism 16. The central control mechanism 18 serves to receive, process and transmit signals for controlling the rail vehicle control mechanism 16, thereby initiating one or more manipulation operations in the rail vehicle 12. The manipulation operation can be one or of the following: (i) adding a rail vehicle 12 to the rail system 14;(ii) removing a rail vehicle 12 from the rail system 14;(iii) coupling a first rail vehicle 12 to a second rail vehicle 12; and (iv) uncoupling a first rail vehicle 12 from a second rail vehicle 12.

In a preferred embodiment, the manipulation system 10 works in conjunction with one or more transfer tables 20 in the rail system 14. The transfer table 20 is a moving section of railway track that allows the rail vehicle 12 to be moved between the rail system 14 and a non-system area 22. In a preferred and non-limiting embodiment, the transfer table 20 moves in a lateral motion with respect to a railway track in the rail system 14, and the non-system area 22 can be a maintenance area, a transfer area, a storage area, etc.

In a first aspect of the present invention, the manipulation operation is initiated by the central control mechanism 18, which requests the addition of a rail vehicle 12 to the rail system 14. Since the central control mechanism 18 and the rail vehicle control mechanism 16 are in wireless communication with each other, and are both capable of receiving, processing and transmitting control signals, either the central control mechanism 18 or the rail vehicle control mechanism 16 initially verifies that the rail vehicle 12 includes the requisite rail vehicle control mechanism 16 and, further, that the rail vehicle 12 is positioned on the transfer table 20. Next, either the central control mechanism 18 or the rail vehicle control mechanism 16, and typically the central control mechanism 18, verifies and controls the relative position of other rail vehicles 12 in the rail system 14, and commands that the transfer table 20 move into operable communication with the railway track in the rail system 14. Finally, a rail vehicle 12 is either added individually to the rail system 14 or added to a subsequent rail vehicle 12 in a train, where the train includes at least one and typically multiple rail vehicles 12. In this manner, a rail vehicle 12 is added to the rail system 14 via the transfer table 20.

The central control mechanism 18 also routes this rail vehicle 12 in the current direction of traffic in the rail system 14. Finally, the central control mechanism 18, in conjunction with the rail vehicle control mechanism 16, initiates a normal rail vehicle operational mode. At this point, the central control mechanism 18 may request that the transfer table 20 be moved out of operable communication with the railway track in the rail system 14.

In another aspect of the present invention, the manipulation operation is initiated by the central control mechanism 18 and requests the removal of a rail vehicle 12 from the rail system 14. Again, either the central control mechanism 18 or the rail vehicle control mechanism 16, and typically the central control mechanism 18, verifies that an empty transfer table 20 is in operable communication with the railway track in the rail system 14 and/or positions an empty transfer table 20 in operable communication with the railway track in the rail system 14. Next, the rail vehicle 12 to be removed from the rail system 14 is routed to the transfer table 20. The rail vehicle 12 is then berthed on the transfer table 20 and, further, the rail vehicle 12 is properly aligned, such that removal via the transfer table 20 is feasible. Again, as with the addition of a rail vehicle 12 to the rail system 14, the rail vehicle 12 may be removed individually from the rail system 14 via the transfer table 20 or the rail vehicle 12 may be first uncoupled from a subsequent rail vehicle 12 in a train and then removed from the rail system 14 via the transfer table 20.

In a preferred embodiment, the rail system 14 includes one or more berthing stations 24 positioned adjacent the transfer table 20. In a preferred and non-limiting embodiment, the rail system 14 includes one berthing station 24 positioned adjacent a first side of the transfer table 20 and another berthing station 24 positioned adjacent a second side of the transfer table 20.

In a further aspect of the present invention, the manipulation system 10 includes a first rail vehicle control mechanism 26 in communication with a first rail vehicle 28 for receiving, processing and transmitting signals for controlling the operation of the first rail vehicle 28, and further includes a second rail vehicle control mechanism 30 in communication with a second rail vehicle 32 for receiving, processing and transmitting signals for controlling the operation of the second rail vehicle 32. While a first rail vehicle control mechanism 26 and a second rail vehicle control mechanism 30 are specifically discussed, any number of rail vehicle control mechanisms 16 in communication with respective rail vehicle 12 is envisioned. The central control mechanism 18 is capable of wirelessly communicating with and controlling a large quantity of rail vehicle control mechanisms 16, and subsequently the associated rail vehicle 12, in the rail system 14.

In a further aspect of the present invention, the manipulation operation is initiated by the central control mechanism 18 and requests the coupling of the first rail vehicle 28 to the second rail vehicle 32. Any one of the central control mechanism 18, the first rail vehicle control mechanism 26 and the second rail vehicle control mechanism 30, and typically the central control mechanism 18, verifies a train length and the existence of a communication link between the central control mechanism 18, the first rail vehicle control mechanism 26 and the second rail vehicle control mechanism 30. These are necessary prerequisites, since train length is a predetermined and set requirement, such that only the required quantities of rail vehicles 12 are linked together. In addition, the manipulation system 10 must verify that appropriate communication is established through the various control mechanisms. Next, the second rail vehicle 32 is held on a transfer table 20, and the first rail vehicle 28 is routed to a coupling location. The first rail vehicle 28 is maintained at the coupling location, and the first rail vehicle 28 position is verified at the coupling location. Next, the second rail vehicle 32 is routed from the transfer table 20 to the coupling location in the direction of the coupling location. Finally, the second rail vehicle 32 is coupled to the first rail vehicle 28 at the coupling location. In this manner, the first rail vehicle 28 and the second rail vehicle 32 are coupled in a controlled setting.

In one preferred and non-limiting embodiment, during the coupling operation, the central control mechanism 18, the first rail vehicle control mechanism 26 and/or the second rail vehicle control mechanism 30: (i) brake the first rail vehicle 28 when the second rail vehicle 32 is within a predetermined distance and moving at a known speed; (ii) brake the second rail vehicle 32 until the second rail vehicle 32 reaches a crawl speed; (iii) maintain the crawl speed of the second rail vehicle 32 until a predetermined buffer distance is attained between the second rail vehicle 32 and the first rail vehicle 28; (iv) disable propulsion of the second rail vehicle 32; (v) determine a worse-case distance for the second rail vehicle 32, based upon kinetic energy of the second rail vehicle 32; (vi) if necessary, brake the second rail vehicle 32; and (vii) drift the second rail vehicle 32 into the first rail vehicle 28, thereby coupling the second rail vehicle 32 to the first rail vehicle 28. The predetermined distance and the buffer distance are calculated using specified parameters. For example, these parameters may include known speed, the coupling speed, the grade of the railway track, the mass of a fully-loaded rail vehicle 12, the mass of an empty rail vehicle 12, etc. The rail vehicle 12 may be positioned in the train that consists of one or more subsequent rail vehicles 12, and one of the rail vehicle control mechanisms 16 on one of the rail vehicles 12 transmits train length and the rail vehicle data to the central control mechanism 18.

The central control mechanism 18 places a protection zone around the train where other trains are not permitted to enter, stores rail vehicle 12 data and verifies rail vehicle 12 data and train length. Further, the central control mechanism 18 selects a control rail vehicle 12 in the train and assigns a group identifier to all rail vehicles 12 in the same train. Next, the central control mechanism 18 and/or the rail vehicle control mechanism 16 confirms reinitialization of the rail vehicle 12; removes the protection zone from the train; releases the brakes on a rail vehicle 12 in the train; and routes the train in the direction of traffic for normal operation in the rail system 14.

In a still further aspect of the present invention, the manipulation operation is initiated by the central control mechanism 18 and requests the uncoupling of the first rail vehicle 28 from the second rail vehicle 32. The central control mechanism 18, the first rail vehicle control mechanism 26 and/or the second rail vehicle control mechanism 30 verifies the train length and the existence of a communication link between the central control mechanism 18, the first rail vehicle control mechanism 26 and the second rail vehicle control mechanism 30. Next, the position of other trains in the rail system 14 is verified and a lead control rail vehicle 12 in the train is assigned. Finally, the first rail vehicle 28 is uncoupled from the second rail vehicle 32.

In one preferred and non-limiting embodiment, during the uncoupling operation, the central control mechanism 18, the first rail vehicle control mechanism 26 and/or the second rail vehicle control mechanism 30: (i) brake the first rail vehicle 28, thereby disconnecting the first rail vehicle 28 from the second rail vehicle 32; (ii) brake the second rail vehicle 32; and (iii) determine the adjusted train length. It is possible that the first rail vehicle 28 is part of a first train and the second rail vehicle 32 is part of a second train. In this case, the central control mechanism 18 or one of the rail vehicle control mechanisms 16 determines the first train length and second train length; place a protection zone around the first train and the second train; stores rail vehicle 12 data for the rail vehicles 12 and the first train and the second train; verifies the rail vehicle 12 data for the first train and the second train; and resolves the rail vehicle 12 data for the first train and the second train.

The central control mechanism 18 selects a control rail vehicle 12 for the first train and the second train and assigns a group identifier to all rail vehicles 12 in the same train. The initialization status of the first train and the second train is confirmed, and the braking of the second train is released. The second train is provided with an uncouple route, thereby guiding the second train away from the first train, and then a verification process is run to determine that the second train has completed the uncouple route. Next, the protection zone is removed from the second train, and the second train is routed in the direction of traffic for normal operation in the rail system 14. Finally, the first train is removed from the rail system 14 via a transfer table 20, as discussed above.

Both the central control mechanism 18 and the rail vehicle control mechanism 16 may be broken down into various subcomponents and operating systems designated to complete specified tasks. In one preferred and non-limiting embodiment, the central control mechanism 18 is one or more region-specific wayside control mechanisms 34 that are in communication with multiple rail vehicle control mechanisms 16 in a set region, and the region-specific wayside control mechanism 34 receives, processes and transmits signals for controlling the rail vehicle control mechanisms 16. In this embodiment, the central control mechanism 18 also includes a main control mechanism 36 that is in communication with the region-specific wayside control mechanism 34 and serves to receive, process and transmit signals for controlling the region-specific wayside control mechanism 34. In this embodiment, the region-specific wayside control mechanism 34 also includes various subcomponents and subprograms. In this embodiment, the region-specific wayside control mechanism 34 includes a regional automatic train protection system 38 for regulating vital train functions within a specified region, for example, vital train route selection and conflict points. The region-specific wayside control mechanism 34 also includes a regional automatic train operation system 40 for regulating non-vital train functions within a specified region, such as non-vital train route selection and signal display.

Similarly, the rail vehicle control mechanism 16 may also be made up of subcomponents and subprograms. In this embodiment, the rail vehicle control mechanism 16 includes a vehicle automatic train protection system 42 for regulating vital rail vehicle functions, such as positive train separation, safe speed determination, position determination, vehicle door operation enablement, train initialization, trainline control and monitoring, sensor processing, holding the rail vehicle 12 in a stopped position during passenger exchange and communicating with the central control mechanism 18. In this embodiment, the rail vehicle control mechanism 16 also includes a vehicle automatic train operation system 44 for regulating non-vital rail vehicle 12 functions, such as speed control under safe speed limit, door opening and closing, controlling passenger information devices, displaying information on a diagnostic display, diagnostic logging and fault logging.

In a further aspect of the present invention, the manipulation system 10, and specifically the rail vehicle control mechanism 16, wirelessly transmits a signal that is representative of the associated rail vehicle 12. The central control mechanism 18 receives and processes the signal, thereby identifying the rail vehicle 12. In this embodiment, the rail vehicle 12 is equipped with a unique identification tag 46 that transmits a unique identification data signal related to the associated rail vehicle 12. Further, the central control mechanism 18 includes a reader device 48 for receiving and processing this unique identification data signal. The unique identification data signal can be in the form of a radio frequency signal, a digital signal, an analog signal, etc. In one preferred and non-limiting embodiment, the unique identification data signal is a radio frequency signal, and the identification tag 46 is a transponder that is activated by the central control mechanism 18 and the signal read by the reader device 48.

In another preferred and non-limiting embodiment, the rail vehicle control mechanism 16 and the central control mechanism 18 include at least one collision control unit. This collision control unit determines a coupling speed. In addition, the coupling speed is based upon the rail vehicle 12 kinetic energy. This collision control unit is used in conjunction with the coupling process as discussed in detail above.

In yet another preferred and non-limiting embodiment, the rail vehicle control mechanism 16 and/or the central control mechanism 18 validate that a transfer table 20 contains an initialized rail vehicle 12. In addition, the position of a rail vehicle 12 on a guideway is verified, such that the rail vehicle 12 is not stopped outside of a station during a manipulation operation. In addition, the rail vehicle control mechanism 16 and/or the central control mechanism 18 verifies that the transfer table 20 is in an appropriate position and verifies that coupling and uncoupling conditions are met prior to performing a coupling and uncoupling operation. The rail vehicle control mechanism 16 and/or the central control mechanism 18 can be a personal computer, a computing device, a central processing unit, a printed circuit board, etc. It is the contactless communication based system, such as a wireless communication link, between the central control mechanism 18 and the rail vehicle control mechanism 16 that provides the unique and flexible control of the rail vehicles 12 in the rail system 14.

The present invention is also directed to a method of automatically manipulating a rail vehicle 12 on the railway system 14. This method includes the steps of: (i) providing a rail vehicle control mechanism 16 in communication with a rail vehicle 12 for controlling the operation of the rail vehicle 12; (ii) providing a central control mechanism 18 in wireless communication with the rail vehicle control mechanism 16; (iii) and initiating one or more manipulation operations in the rail vehicle 12. Again, these sequences may include: (i) adding a rail vehicle 12 to the rail system 14; (ii) removing a rail vehicle 12 from the rail system 14; (iii) coupling a first rail vehicle 28 to a second rail vehicle 32; and (iv) uncoupling a first rail vehicle 28 from a second rail vehicle 32. The method effects the operation of the central control mechanism 18 and the rail vehicle control mechanism 16 as discussed in detail hereinabove.

EXAMPLES

Referring to FIGS. 2*a*–6*f*, various schematic flow charts are illustrated and refer to specific and preferred embodiments of the manipulation system 10. In addition, these figures represent the embodiment wherein the central control mechanism 18 is made up of the main control mechanism 36, the regional automatic train protection system 38, and the regional automatic train operation system 40. Similarly, in the embodiment, the rail vehicle control mechanism 16 includes the vehicle automatic train protection system 42 and the vehicle automatic train operation system 44.

FIGS, 2*a*–6*d* illustrate the addition of a rail vehicle 12 to the rail system 14, where the transfer table 20 is left on a guideway (the guideway position is 2B/6B, and the maintenance position is 3C/5C). The mainipulation operation is an "add train" sequence. A rail vehicle 12 is added to the rail system 14 (either in a loop or shuttle in both normal and reverse directions) when the main control mechanism 36 sends an "add train" request to the region-specific wayside control mechanism 34. After verifying that the transfer table 20 contains an initialized rail vehicle 12, the region-specific wayside control mechanism 34 immediately acknowledges the "add train" request (sequence no. 1–4). Next the reigon-specific wayside control mechanism 34 will check conditions to verify that all trains on the guidewire are either routed or held at resective stations, such that they will not be stopped on the guidway outside a station during the sequence (sequence no. 5 and 6).The transfer table 20 will be moved into the guidway after the region-specfic wayside control mechanism 34 confirms that vital transfer table 20 conditions are met, whereby it notifies the main control mechanism 36 that the transfer table is in the 2B/6B position (sequence no.7–10). Once the transfer table 20 is in the guidway, the remaining "add train" sequences will be different depending upon whether the transfer table 20 remains in the guidway or not.

The "add car" sequence with the transfer table 20 returned to the maintenance area is shown in FIGS. 3*a*–3*f*. A rail vehicle 12 will be added to the rail system 14 when the main control mechanism 36 sends an "add car" request to the region-specific control mechanism 34, including the identification of the existing rail vehicle 12 to be coupled. After verifying that the transfer table 20 contains an initialized train, the region-specific wayside control mechanism 34 immediately acknowledges the "add car" request (sequence no. 1–4). The region-specific wayside control mechanism 34 will route the existing trains on the guideway to stations to allow coupling of the target train (sequence no. 5 and 6). It will also verify train routes to ensure proper spacing is not violated before the transfer table 20 is moved (sequence no. 7). The transfer table 20 will be moved into the guideway after the region-specific wayside control mechanism 34 confirms that vital transfer table conditions are met, whereby it notifies the main control mechanism 36 that the transfer table is in the 2B/6B position (sequence no. 8–11). Once the transfer table 20 is in the guideway, the remaining "add car" sequence will be different depending upon whether the transfer table 20 remains in the guideway or not. The "add car" request can be aborted any time after sequence no. 2 and before sequence no. 18, or after sequence no. 2 and before sequence no. 13 (depending upon transfer table 20 position), at which time the region-specific wayside. control mechanism 34 cancels the "add car" maneuver. If the transfer table 20 is in the process of moving, the "add car" request will be revoked regardless of transfer table 20 position.

FIGS. 4*a*–4*f* illustrate the automatic coupling of the first rail vehicle 28 to the second rail vehicle 32. Automatic coupling (building one train from either one- or two-vehicle trains) can be performed only in designated train makeup areas of the rail system 14 guideway. The auto-couple sequence represents the example of coupling a one-vehicle train that is positioned on a transfer table 20 (train 2) to another train that is berthed or being held at a platform (train 1). Since the auto-couple sequence will not succeed unless all rail vehicles 12 in the train are fully functional (that is communicating and with no class 1 or class 2 alarms), the region-specific wayside control mechanism 34 will coordinate to ensure that this condition is met before initiating auto-couple. In addition, the region-specific wayside control mechanism 34 will ensure that any incorrect couple configuration requests are rejected, e.g., the region-specific wayside control mechanism 34 will reject any request that would either result in a train length of greater than three vehicles or in a coupling operation with a non-communicating train. Before the region-specific wayside control mechanism 34 initiates the requested auto-couple sequence, it will ensure that other trains in the rail system 14 are at locations such that they will not be stopped on the guideway outside a station during the auto-couple process. In addition, only while the rail vehicle control mechanism 16 is in an "automatic" mode, and if an unrequested couple occurs, the controlling vehicle's rail vehicle control mechanism 16 will immediately send an "unrequested couple bit" to notify the region-specific wayside control mechanism 34 that the train length has increased and will also notify the region-specific wayside control mechanism 34 of the number of rail vehicles 12 in a changed consist.

The rail vehicle 12 will auto-couple to an existing one- or two-vehicle train when the region-specific wayside control mechanism 34 sends an appropriate request (sequence no. 1). The region-specific wayside control mechanism 34 immediately acknowledges the request by sending a "couple in progress" indication to the main control mechanism 36, and then train 1 is routed to the couple location, which must be a station platform, and also gives a "hold train" command at the station (sequence no. 2 and 3). When train 1 arrives at the couple location, it confirms that it is properly berthed (sequence no. 4), and, in the meantime, the region-specific wayside control mechanism 34 is holding train 2 on the transfer table with its emergency brake set by sending it a normal route message with front and rear conflict points equal to the transfer table 20 boundaries and a conflict point of type "transfer table". This causes train 2 to shrink its virtual occupancy to equal the transfer table 20 boundaries.

When train 1 arrives at the couple location, which must be a station platform, and train 2 is positioned on the transfer table 20 in the proper position (which is performed by the "add car" function), the regional automatic train protection system 38 sends a normal route to the couple location with a front conflict point outside of the transfer table 20 segment and a conflict point of type "train" (sequence no. 5). As soon as train 2 sees its conflict point type change from "transfer table" to a different type, this will cause train 2 to reset its emergency brakes and to leave the transfer table 20 travelling at the civil speed (sequence no. 5). The regional automatic train protection system 38 continuously sends the transfer table 20 and train location to the regional automatic train operation system 40, and as soon as the regional automatic train operation system 40 verifies that the transfer table 20 is locked in the proper position on the guideway, it waits until train 2 is within a predetermined, speed-dependent distance from the front conflict point (sequence no. 6), for example, at 27 miles per hour when it is 455 feet away from the front conflict point.

Then, the regional automatic train operation system 40 issues a couple command to the regional automatic train protection system 38, and, once received, a "couple command" message is sent to both trains, which contains two couple bits—one for the stationary train, train 1, and one for the moving train, train 2 (sequence no. 7). As soon as train 1's vehicle automatic train protection system 42 sees the stationary couple bit set, it immediately applies emergency brakes and remains at zero speed (sequence no. 7). In addition, the regional automatic train protection system 38 sends a "couple route" message to the moving train only, train 2, and thus, the regional automatic train protection system 38 will send a "couple route" message to train 2, with a front conflict point equal to the tail virtual occupancy of the stationary train (train 1), and with a conflict point of type "couple". This causes train 2 to smoothly service brake down from the civil speed to a crawl speed of 2–4 miles per hour and maintain the crawl speed for approximately 50 feet, until it reaches a predetermined buffer distance. Train 2 interprets the "couple route" message as a command to safely drive into the rear of train 1, and train 2 performs calculations such that: (i) it maintains a profile that ensures it does not collide with train 1 at a speed greater than 2–4 miles per hour (sequence no. 8); and (ii) when its head footprint is within a predetermined buffer distance from its front conflict point (i.e., the tail VO of train 1, which is approximately 10 feet away from train 1), it disables propulsion and coasts for the last buffer distance into the end of train 1 (sequence no. 9). If necessary, train 2 will apply emergency brakes if the speed exceeds the safe impact profile.

Following successful mechanical coupling, the end 1 and end 2 relays at the coupled ends of the trains will automatically configure the train lines to reflect a two- or three-vehicle train. The mechanical couplers provided at each end of the rail vehicles 12 allow for coupling of any two vehicle ends and also ensures that electrical, mechanical and pneumatic connections occur automatically. After the two-vehicle rail vehicle control mechanism 16 sends the consist change (sequence no. 10), the emergency brakes on train 1 and train 2 are applied (sequence no. 11). At this point, the two trains are physically and electrically coupled into one train, the consist has changed and, therefore, the consist needs to undergo a remove train identification and an initialized train process. As soon as the consist changes, the control mechanism 16 will immediately send a "couple bit" to notify the regional automatic train protection system 38 that the train length has increased and will also notify the regional automatic train protection system 38 of the number of vehicles in the changed consist. As soon as the controlling vehicle rail vehicle control mechanism 16 has verified to the region-specific wayside control mechanism 34 that the consist has changed, the region-specific wayside control mechanism 34 will place a segment block around train 1 and train 2 until the auto-couple sequence is completed (sequence no. 10). Before issuing any remove train identification commands, the region-specific wayside control mechanism 34 will store the train 1 and train 2 information in its database for later use in re-initializing the new consist. Then, the region-specific wayside control mechanism 34 will proceed to issue a remove train identification command to train 1 and train 2 and remove them from its database (sequence no. 12). The region-specific wayside control mechanism 34 will also inform the main control mechanism 36 when it initiates and completes removing both train identifications.

As soon as train 1 and train 2's rail vehicle control mechanisms 16 confirm that the remove train identification command is complete (sequence no. 13), the region-specific wayside control mechanism 34 will then immediately re-initialize the new two- or three-vehicle train by sending the new train consist information, selecting a controlling rail vehicle 12, and assigning all of rail vehicles 12 the same train radio address (sequence no. 14). The region-specific wayside control mechanism 34 will also inform the main control mechanism 36 when it starts and completes the initialization of the new coupled train into its database, and the rail vehicle control mechanism 16 will confirm the new train consist information to the region-specific wayside control mechanism 34 as part of its initialization process.

As soon as the rail vehicle control mechanism 16 confirms the initialization of the new coupled train, the region-specific wayside control mechanism 34 will then, in turn, remove the segment block it had set up prior to removing the two trains and will confirm to the main control mechanism 36 that the auto-couple process is complete (sequence no. 15). In addition, the vehicle automatic train protection system 42 will also confirm to the vehicle automatic train operation system 44 that initialization of the new coupled train is complete, so that the vehicle automatic train protection system 42 knows when to reset the emergency brakes. After the vehicle automatic train operation system 44 on the new coupled train has requested a local reset (sequence no. 16), the vehicle automatic train protection system 42 will reset the emergency brakes (sequence no. 17). After the emergency brakes on the train have been reset, the region-specific wayside control mechanism 34 can then route the newly-coupled train within the rail system 14 and place it in normal operation. The couple request can be aborted anytime after sequence no. 1 and before sequence no. 10, at which time each controlling rail vehicle control mechanism 16 cancels the coupling maneuver.

The "remove car" sequence with the transfer table return to the maintenance position is illustrated in FIGS. 5*a*–5*f*. A rail vehicle 12 will be removed from the rail system 14 when the main control mechanism 36 sends a "remove car" request to the region-specific wayside control mechanism 34. After verifying that the transfer table contains no occupancy, the region-specific wayside control mechanism 34 immediately acknowledges the "remove car" request (sequence no. 1–3). The transfer table 20 will be moved into the guideway after the region-specific wayside control mechanism 34 confirms that vital transfer table 20 conditions are met (sequence no. 4 and 5). The region-specific wayside control mechanism 34 will route the target train to the transfer table 20 (virtual station) to allow uncoupling of the target train (sequence no. 6), and after the target train is berthed and held at a station, the region-specific wayside control mechanism 34 informs the main control mechanism 36 (sequence no. 7).

The region-specific wayside control mechanism 34 then verifies the train's alignment and initiates the uncouple sequence (sequence no. 8 and 9). If any improper alignment is detected, the uncouple sequence is aborted. The transfer table 20 is then moved back into the maintenance area by the region-specific wayside control mechanism 34 (sequence no. 10). The region-specific wayside control mechanism 34 will notify the main control mechanism 36 when the transfer table 20 is in the 3C/5C position (sequence no. 11) and when the "remove car" sequence has been completed (sequence no. 12). The "remove car" request can be aborted anytime after sequence no. 3 and before sequence no. 10, at which time the region-specific wayside control mechanism 34 cancels the "remove car" maneuver. If the transfer table 20 is in the process of moving, the "remove car" request will be revoked regardless of transfer table 20 position.

The auto-uncouple sequence, wherein rail vehicles 12 are separated, are illustrated in FIGS. 6*a*–6*f*. For automatic uncoupling to occur, the rear rail vehicle 12 of the train is desirably positioned on the transfer table 20. However, this is not to be construed as limiting the invention since the rear rail vehicle 12 can be uncoupled when positioned off the transfer table. The transfer table 20 is modeled as a "virtual station" with five associated virtual berths, where the transfer table 20 is the center berth. This allows a train to be driven in either the system normal or the system reverse direction, such that either end of the train may be positioned on the transfer table 20 for uncoupling.

The auto-uncouple sequence represents the case of uncoupling a two-vehicle train that is positioned with the rear vehicle on a transfer table 20 (train 2). However, the manipulation system 10 can also handle the auto-uncoupling of two- or three-vehicle trains. Since the auto-uncouple sequence will not succeed unless all rail vehicles 12 in the train are fully functional, that is in a communication state with no class 1 or class 2 alarms, the regional automatic train protection system 38 and the regional automatic train operation system 40 will coordinate to ensure that this condition is met before initiating the auto-uncouple sequence. In addition, the region-specific wayside control mechanism 34 will ensure that any incorrect uncouple configuration requests are rejected, e.g., a request to uncouple a one-vehicle train or to uncouple a non-communicating vehicle from a communicating train. Before the regional automatic train operation system 40 initiates the request on an auto-uncouple sequence, it will ensure that other trains in the system are at locations, such that they will not be stopped in the guideway outside a station during the auto-uncouple process. In addition, while the rail vehicle control mechanism 16 is in an "automatic" mode, if an unrequested uncouple occurs, the controlling vehicle rail vehicle control mechanism 16 will immediately set an "unrequested uncouple bit" to notify the regional automatic train protection system 38 that the train length has decreased and will also notify the regional automatic train protection system 38 of the number of rail vehicles 12 in the changed consist.

The auto-uncouple sequence is initiated by the main control mechanism 36. A rail vehicle 12 in a multi-vehicle train will auto-uncouple from the leading one- or two-vehicle train when the request is sent (sequence no. 1). The region-specific wayside control mechanism 34 immediately acknowledges the request by sending an "uncouple in progress" for an indication to the main control mechanism 36. The region-specific wayside control mechanism 34 then routes the train to the uncouple location, which must be a "virtual station" (i.e., a transfer table 20 which has five associated virtual berths), and also gives a "hold train" command at that station (sequence no. 2 and 3). When the train arrives at the uncouple location, it confirms that it is properly berthed, with the trailing vehicle properly aligned on the transfer table 20, as indicated by the wayside sensors (sequence no. 4). The controlling rail vehicle control mechanism 16 will handle aligning the trailing vehicles properly on the transfer table 20, and the region-specific wayside control mechanism 34 will select the leading vehicle as the controlling rail vehicle control mechanism 16 (sequence no. 5). After the rail vehicle control mechanism 16 has confirmed that the lead vehicle is the controlling vehicle (sequence no. 6) and after the region-specific wayside control mechanism 34 verifies, via the photo sensors on the transfer table 20, that there is only one rail vehicle 12 on the transfer table 20, and that it is properly aligned, the region-specific wayside control mechanism 34 will issue an uncouple command to the controlling rail vehicle control mechanism 16 to uncouple from the trailing vehicle (sequence no. 7). All vehicles in the train will receive this command, but only the controlling vehicle will respond to it.

An uncoupled trailing vehicle trainline is provided to disconnect all electrical, mechanical and pneumatic connections. It is energized by the vehicle automatic train operation system 44 during an automatic uncouple. After receiving an uncouple command (sequence no. 7), the controlling rail vehicle control mechanism 16 energizes the uncouple trailing vehicle train line (sequence no. 8) and then moves the leading train away, thus physically separating or uncoupling the last vehicle from the train, although the two train's virtual occupancies still overlap (sequence no. 9). In addition, as soon as the uncouple trailing vehicle trainline is energized, this will automatically cause the emergency brakes in the trailing vehicle to apply, such that the uncoupled vehicle will remain stationary in the transfer table 20 throughout the entire auto-uncoupling sequence. Thus, following successful mechanical uncoupling, the emergency brakes in the trailing vehicle will automatically be applied via the train hardware (sequence no. 9). At this point, the rail vehicle control mechanism 16 has electrically uncoupled the trailing vehicle, although the leading train and trailing vehicle are physically separated by only enough distance to allow the coupler's doors to close.

Following the successful mechanical uncoupling, the end 1 and end 2 relays at the uncoupled ends of the trains will automatically configure the trainlines to reflect a one- or two-vehicle train. The mechanical couplers provided at each end of the vehicles allow for uncoupling of any two vehicle ends and also ensures that all electrical, mechanical and pneumatic connections occur automatically. After the controlling rail vehicle control mechanism 16 senses the consist change (sequence no. 10), it will apply the emergency brakes on train 1 and train 2 (sequence no. 11). At this point, the original train is physically and electrically uncoupled into two trains, the consist has changed, and therefore, both consists need to undergo a "remove train" identification and initialized train process. As soon as the consist changes, the controlling rail vehicle control mechanism 16 will immediately set an "uncouple bit" to notify the regional automatic train protection system 38 that the train length has decreased and will also notify the number of vehicles in the changed consist.

As soon as the controlling rail vehicle control mechanism 16 has verified to the region-specific wayside control mechanism 34 that the consist has changed, the region-specific wayside control mechanism 34 will place a segment block around train 1 and train 2 until the auto-uncouple sequence is complete (sequence no. 10). Before issuing any "remove train" identification command, the region-specific wayside control mechanism 34 will store the original train information in its database for later use in re-initializing the new consist. Next, the region-specific wayside control mechanism 34 will proceed to issue a "remove train" identification command to the original train and remove the train from its database (sequence no. 12). The region-specific wayside control mechanism 34 will also inform the main control mechanism 36 when it initiates and completes removing the original train identification, and as soon as the original train's rail vehicle control mechanism 16 confirms that the "remove train" identification command is complete (sequence no. 13), the region-specific wayside control mechanism 34 will then immediately re-initialize the two new one- or two-vehicle trains by sending the new train consist information, selecting a controlling rail vehicle 12, and assigning all rail vehicles 12 to the same train radio address (sequence no. 14).

The region-specific wayside control mechanism 34 will also inform the main control mechanism 36 when it starts and completes the initialization of the new uncoupled trains into its database. The two-vehicle rail vehicle control mechanism 16 will confirm both sets of new train consists information to the region-specific wayside control mechanism 34 as part of their initialization process. As soon as this confirmation occurs, the region-specific wayside control mechanism 34 will send an "initialization complete" indication to the main control mechanism 36 (sequence no. 15). In addition, the rail vehicle control mechanisms 16 will also confirm to the vehicle automatic train operation systems 44 that the initialization of train 1 and train 2 is complete, so that the vehicle automatic train protection system 42 knows when to reset the emergency brakes. Only the vehicle automatic train operation system 44 and the leading train (train 1), which is not on the transfer table 20, will request a reset of the emergency brakes. This is to ensure that the trailing vehicle (train 2) remains stationary in the transfer table 20, such that the region-specific wayside control mechanism 34 can move the transfer table 20 from the guideway. After the vehicle automatic train operation system 44 on train 1 requests a local reset (sequence no. 16), its vehicle automatic train protection system 42 will reset the emergency brakes (sequence no. 17).

After the emergency brakes on train 1 have been reset, the region-specific wayside control mechanism 34 will send an "uncouple route" to the leading train that ignores the uncoupled vehicle's conflict point (sequence no. 18). Thus, the region-specific wayside control mechanism 34 will send an uncouple route message to train 1, with front and rear conflict points, which are outside of the trailing vehicle's virtual occupancy (train 2), and this conflict point type is not equal to "transfer table". The leading train (train 1) will then proceed to drive in an automatic way from the trailing vehicle (train 2). The uncoupled vehicle (train 2) will leave its emergency brake set regardless of what type of route or conflict points it receives from the regional automatic train protection system 38. This allows the leading train to be routed away from the uncoupled vehicle and placed in normal operation. This also allows the uncoupled vehicle, which is located on transfer table 20, to be moved into storage in the maintenance area via the transfer table 20. If the region-specific wayside control mechanism 34 wants to move the uncoupled vehicle into a storage area via the transfer table 20, the regional automatic train protection system 38 will send a route message to the uncoupled vehicle on the transfer table 20 with front and rear conflict points equal to the transfer table 20 boundaries and a conflict point of type "transfer table". This informs the rail vehicle control mechanism 16 to leave its emergency brake set, and also to shrink its head and tail virtual occupancy to match the transfer table 20 boundaries, since the rail vehicle 12 virtual occupancy cannot overlap the transfer table 20.

When train 1 has completed the uncouple route, it will stop and confirm this to the region-specific wayside control mechanism 34 (sequence no. 19), and as soon as the train 1 rail vehicle control mechanism 16 confirms completion of the uncouple route to the region-specific wayside control mechanism 34, the segment block that was set up prior to removing the original train will be removed and a confirmation sent to the main control mechanism 36 that the auto-uncouple process is complete (sequence no. 20). If the region-specific wayside control mechanism 34 needs to route the uncoupled vehicle, which is located on transfer table 20, to another location on the track, it may do so after train 1 completes its uncouple route. To do so, first the regional automatic train operation system 40 must set a remote reset to the uncoupled vehicle (train 2). This tells the vehicle to reset its emergency brakes. This will cause the uncoupled vehicle's vehicle automatic train operation system 44 to request a reset of the emergency brakes, and after this request, train 2 will reset the emergency brakes. Then, the regional automatic train protection system 38 will send a route message with a front conflict point outside of the transfer table 20 segment and conflict points whose types do not equal "transfer table". This allows the uncoupled vehicle to be routed to another location on the track and placed in normal operation.

The uncouple request can be aborted at any time after sequence no. 1 and before sequence no. 10, at which time the controlling vehicle rail vehicle control mechanism 16 cancels the uncoupling maneuver. Once the region-specific wayside control mechanism 34 receives notice from the rail vehicle control mechanism 16 that a consist change has occurred, the region-specific wayside control mechanism 34 will attempt to proceed in the same fashion as it would for an auto-uncouple operation, i.e., attempt to remove the original train's identification and to initialize the two uncoupled trains. As soon as the rail vehicle control mechanism 16 confirms that the "remove train" process is complete and that the leading train has completed its uncouple route, the region-specific wayside control mechanism 34 will clear the segment block around trains 1 and 2 and send an "uncouple complete" indication to the main control mechanism 36, just as it would for a normal auto-uncoupling sequence.

Overall, the present invention provides a manipulation system 10 and method for use in connection with rail vehicles 12 operating in a rail system 14. By using wireless communication between the central control mechanism 18 and the various rail vehicle control mechanisms 16, a contactless or wireless control environment operates in conjunction with the transfer tables 20. This wireless communication and control eliminate the need for human force to initiate various actions on rail vehicles 12, which similarly eliminates human error. The manipulation system 10 and method are particularly adapted to adding rail vehicles 12 to the rail system 14, removing rail vehicles 12 from the rail system 14, and coupling and uncoupling rail vehicles 12 from each other.

This invention has been described with reference to the preferred embodiments. Obvious modifications and alterations will occur to others upon reading and understanding the preceding detailed description. It is intended that the invention be construed as including all such modifications and alterations.

The invention claimed is:

1. An automated manipulation system for manipulating at least one vehicle in a transit system, the automated manipulation system comprising:

a vehicle control mechanism in communication with the at least one vehicle and configured to receive, process and transmit signals for controlling the operation of the vehicle; and a central control mechanism in contactless or wireless communication with the vehicle control mechanism and configured to receive, process and transmit signals for controlling the vehicle control mechanism and thereby initiating at least one manipulation operation in the vehicle, wherein the manipulation operation is at least one of:

(i) adding a vehicle to the transit system;

(ii) removing a vehicle from the transit system;

(iii) coupling a first vehicle to a second vehicle; and (iv) uncoupling a first vehicle from a second vehicle.

2. The manipulation system of claim 1, wherein the transit system includes at least one transfer table comprising a moving section of transit path configured to allow the vehicle to be moved between the transit system and a non-system area.

3. The manipulation system of claim 2, wherein the transfer table moves in a lateral motion with respect to a railway track in the transit system, and the non-system area is at least one of a maintenance area, a transfer area and a storage area.

4. The manipulation system of claim 2, wherein the manipulation operation is initiated by the central control mechanism and requests the addition of a vehicle, at least one of the central control mechanism and the vehicle control mechanism:

(i) verifying that the vehicle includes the vehicle control mechanism and that the vehicle is positioned on the transfer table;

(ii) one of verifying and controlling the relative position of other vehicles in the transit system;

(iii) commanding the transfer table to move into operable communication with a railway track in the transit system; and (iv) one of adding the vehicle to the transit system and adding the vehicle to a train, the train comprising at least one vehicle.

5. The manipulation system of claim 4, wherein the central control mechanism routes the vehicle in a current direction of traffic in the transit system and initiates a normal vehicle operation mode.

6. The manipulation system of claim 4, wherein the central control mechanism requests that the transfer table be moved out of operable communication with the railway track in the transit system.

7. The manipulation system of claim 2, wherein the manipulation operation is initiated by the central control mechanism and requests the removal of a vehicle, at least one of the central control mechanism and the vehicle control mechanism:

(i) one of verifying that an empty transfer table is in operable communication with the railway track in the transit system and positioning an empty transfer table in operable communication with the railway track in the transit system;

(ii) routing the vehicle to be removed to the transfer table;

(iii) berthing the vehicle to be removed on the transfer table;

(iv) properly aligning the vehicle to be removed on the transfer table; and (v) one of removing the vehicle individually from the transit system via the transfer table and uncoupling the vehicle from a subsequent vehicle in a train and removing the vehicle from the transit system via the transfer table, the train comprising a plurality of coupled vehicles.

8. The manipulation system of claim 7, wherein the transit system includes at least one berthing station positioned substantially adjacent the transfer table.

9. The manipulation system of claim 8, wherein the transit system includes at least one berthing station positioned substantially adjacent a first side of the transfer table and at least one berthing station positioned substantially adjacent a second side of the transfer table.

10. The manipulation system of claim 1 further comprising:

a first vehicle control mechanism in communication with a first vehicle and configured to receive, process and transmit signals for controlling the operation of the first vehicle; and a second vehicle control mechanism in communication with a second vehicle and configured to receive, process and transmit signals for controlling the operation of the second vehicle.

11. The manipulation system of claim 10, wherein the manipulation operation is initiated by the central control mechanism and requests the coupling of the first vehicle to the second vehicle, at least one of the central control mechanism, the first vehicle control mechanism and the second vehicle control mechanism:

(i) verifying at least one of train length and a communication link between the central control mechanism, the first vehicle control mechanism and the second vehicle control mechanism;

(ii) holding the second vehicle at an initial position;

(iii) routing the first vehicle in the transit system to a coupling location;

(iv) maintaining the first vehicle position at the coupling location;

(v) verifying the first vehicle position at the coupling location;

(vi) routing the second vehicle from the initial position to the coupling location in the direction of the coupling location; and (vii) coupling the second vehicle to the first vehicle at the coupling location.

12. The manipulation system of claim 11, wherein, during the coupling operation, at least one of the central control mechanism, the first vehicle control mechanism and the second vehicle control mechanism:

(i) brake the first vehicle when the second vehicle is within a predetermined distance and moving at a known speed;

(ii) brake the second vehicle until the second vehicle reaches a crawl speed;

(iii) maintain the crawl speed of the second vehicle until a predetermined buffer distance is attained between the second vehicle and the first vehicle;

(iv) disable propulsion of the second vehicle;

(v) determine a worst-case distance for the second vehicle, based upon kinetic energy of the second vehicle;

(vi) if necessary, brake the second vehicle; and (vii) drift the second vehicle into the first vehicle, thereby coupling the second vehicle to the first vehicle.

13. The manipulation system of claim 12, wherein at least one of the predetermined distance and the buffer distance is calculated utilizing specified parameters, including at least one of the known speed, the coupling speed, the grade of the railway track, the mass of a fully-loaded vehicle, the mass of an empty vehicle.

14. The manipulation system of claim 11, wherein the vehicle is positioned in a train consisting of at least one subsequent vehicle, at least one of the vehicle control mechanisms transmitting train length and vehicle data to the central control mechanism.

15. The manipulation system of claim 14, wherein the central control mechanism places protection zone around the train, stores vehicle data and verifies at least one of vehicle data and train length.

16. The manipulation system of claim 15, wherein the central control mechanism selects a control vehicle in the train and assigns a group identifier to all vehicles in the same train.

17. The manipulation system of claim 16, wherein at least one of the vehicle control mechanism and the central control mechanism:

(i) confirms reinitialization of the vehicle;

(ii) removes the protection zone from around the train;

(iii) releases brakes on at least one vehicle in the train; and (iv) routes the train in the direction of traffic for normal operation in the transit system.

18. The manipulation system of claim 10, wherein the manipulation operation is initiated by the central control mechanism and requests the uncoupling of the first vehicle from the second vehicle, at least one of the central control mechanism, the first vehicle control mechanism and the second vehicle control mechanism:

(i) verifying at least one of train length and a communication link between the central control mechanism, the first vehicle control mechanism and the second vehicle control mechanism;

(ii) verifying the position of other trains in the transit system;

(iii) assigning a lead control vehicle in the train; and (iv) uncoupling the first vehicle from the second vehicle.

19. The manipulation system of claim 18, wherein during the uncoupling operation, at least one of the central control mechanism, the first vehicle control mechanism and the second vehicle control mechanism:

(i) brake the first vehicle, thereby disconnecting the first vehicle from the second vehicle;

(ii) brake the second vehicle; and (iii) determine the adjusted train length.

20. The manipulation system of claim 19, wherein the first vehicle comprises a first train and the second vehicle comprises a second train; at least one of the central control mechanism and a vehicle control mechanism:

(i) determining a first train length and a second train length;

(ii) placing a protection zone around the first train and the second train;

(iii) storing vehicle data for the vehicles in the first train and the second train;

(iv) verifying the vehicle data for the first train and the second train; and (v) resolving the vehicle data for the first train and the second train.

21. The manipulation system of claim 20, wherein the central control mechanism selects a control vehicle for the first train and the second train and assigns a group identifier to all vehicles in the same train.

22. The manipulation system of claim 21, wherein at least one of the vehicle control mechanism and the central control mechanism:

(i) confirms the initialization status of the first train and the second train;

(ii) releases the braking of the second train;

(iii) provides the second train with an uncouple route, thereby guiding the second train away from the first train;

(iv) verifies that the second train has completed the uncouple route;

(v) removes the protection zone from around the second train; and (vi) routes the second train in the direction of traffic for normal operation in the transit system.

23. The manipulation system of claim 22, wherein the first train is removed from the transit system via a transfer table.

24. The manipulation system of claim 1, wherein the central control mechanism comprises at least one region-specific wayside control mechanism in communication with a plurality of vehicle control mechanisms and configured to receive, process and transmit signals for controlling the vehicle control mechanisms; and a main control mechanism in communication with the at least one wayside control mechanism and configured to receive, process and transmit signals for controlling the at least one wayside control mechanism.

25. The manipulation system of claim 24, wherein the wayside control mechanism comprises a regional automatic train protection system configured to regulate vital train functions within a specified region, including at least one of vital train route selection and conflict points, and a regional automatic train operation system configured to regulate non-vital train functions within a specified region, including at least one of non-vital train route selection and signal display.

26. The manipulation system of claim 24, wherein the vehicle control mechanism comprises a vehicle automatic train protection system configured to regulate vital vehicle functions, including at least one of positive train separation, safe speed determination, position determination, enabling vehicle door operation, train initialization, trainline control and monitoring, sensor processing, holding the vehicle in a stopped position during passenger exchange and communicating with the central control mechanism, and a vehicle automatic train operation system configured to regulate non-vital vehicle functions, including speed control under safe speed limit, door opening and closing, controlling passenger information devices, displaying information on a diagnostic display, diagnostic logging and fault logging.

27. The manipulation system of claim 1, wherein the vehicle control mechanism is configured to wirelessly transmit a signal representative of the associated vehicle and the central control mechanism is configured to receive and process the signal, thereby identifying the vehicle.

28. The manipulation system of claim 27, wherein the vehicle is equipped with a unique identification tag configured to transmit a unique identification data signal related to the associated vehicle, and the central control mechanism includes a reader device configured to receive and process the unique identification data signal.

29. The manipulation system of claim 28, wherein the unique identification data signal is in the form of at least one of a radio frequency signal, a digital signal and an analog signal.

30. The manipulation system of claim 1, wherein at least one of the vehicle control mechanism and the central control mechanism include a collision control unit configured to determine a coupling speed.

31. The manipulation system of claim 30, wherein the coupling speed is based upon vehicle kinetic energy.

32. The manipulation system of claim 1, wherein at least one of the vehicle control mechanism and the central control mechanism is configured to validate that a transfer table contains an initialized vehicle, verifying that at least one other vehicle on a guideway is not stopped outside of a station during a manipulation operation, verifying that the transfer table is in an appropriate position and verifying that coupling and uncoupling conditions are met prior to a coupling and uncoupling operation.

33. The manipulation system of claim 1, wherein at least one of the vehicle control mechanism and the central control mechanism is in the form of at least one of a personal computer, a computing device, a central processing unit and a printed circuit board.

34. A method of automatically manipulating at least one vehicle in a railway system, comprising the steps of:

providing a vehicle control mechanism in communication with the at least one vehicle for controlling the operation of the vehicle;

providing a central control mechanism in wireless communication with the vehicle control mechanism for controlling the vehicle control mechanism;

initiating at least one manipulation operation in the vehicle; and at least one of the steps of:

(i) adding a vehicle to the transit system;

(ii) removing a vehicle from the transit system;

(iii) coupling a first vehicle to a second vehicle; and (iv) uncoupling a first vehicle from a second vehicle.

35. The method of claim 34, further comprising the steps of:

initiating a manipulation operation and requesting the addition of a vehicle, at least one of the central control mechanism and the vehicle control mechanism;

verifying that the vehicle includes the vehicle control mechanism and that the vehicle is positioned on the transfer table;

one of verifying and controlling the relative position of other vehicles in the transit system;

commanding a transfer table to move into operable communication with a railway track in the transit system; and one of adding the vehicle individually to the transit system and adding the vehicle to a train, the train comprising at least one vehicle.

36. The method of claim 35, further comprising the steps of:

routing the vehicle in a current direction of traffic in the transit system; and initiating a normal vehicle operation mode.

37. The method of claim 35, further comprising the step of requesting that the transfer table be moved out of operable communication with the railway track in the transit system.

38. The method of claim 34, further comprising the steps of:

initiating the manipulation operation;

requesting the removal of a vehicle;

one of verifying that an empty transfer table is in operable communication with the railway track in the transit system and positioning an empty transfer table in operable communication with the railway track in the transit system;

routing the vehicle to be removed to the transfer table;

berthing the vehicle to be removed on the transfer table;

properly aligning the vehicle to be removed on the transfer table; and one of removing the vehicle individually from the transit system via the transfer table and uncoupling the vehicle from a subsequent vehicle in a train and removing the vehicle from the transit system via the transfer table, the train comprising a plurality of coupled vehicles.

39. The method of claim 34, further comprising the steps of:

initiating a manipulation operation;

requesting the coupling of a first vehicle to a second vehicle;

verifying at least one of train length and a communication link between the central control mechanism, the first vehicle control mechanism and the second vehicle control mechanism;

holding the second vehicle on a transfer table;

routing the first vehicle in the transit system to a coupling location;

maintaining the first vehicle position at the coupling location;

verifying the first vehicle position at the coupling location;

routing the second vehicle from the transfer table to the coupling location in the direction of the coupling location; and coupling the second vehicle to the first vehicle at the coupling location.

40. The method of claim 39, further comprising the steps of:

braking the first vehicle when the second vehicle is within a predetermined distance and moving at a known speed;

braking the second vehicle until the second vehicle reaches a crawl speed;

maintaining the crawl speed of the second vehicle until a predetermined buffer distance is attained between the second vehicle and the first vehicle;

disabling propulsion of the second vehicle;

determining a worst-case distance for the second vehicle for based upon kinetic energy of the second vehicle;

if necessary, braking the second vehicle; and drifting the second vehicle into the first vehicle, thereby coupling the second vehicle to the first vehicle and creating a train.

41. The method of claim 40, further comprising the steps of:

placing a protection zone around the train;

storing vehicle data; and verifying at least one of vehicle data and train length.

42. The method of claim 41, further comprising the steps of:

selecting a control vehicle in the train; and assigning a group identifier to all vehicles in the same train.

43. The method of claim 42, further comprising the steps of:

confirming reinitialization of the vehicle;

removing the protection zone from around the train;

releasing brakes on at least one vehicle in the train; and routing the train in the direction of traffic for normal operation in the transit system.

44. The method of claim 34, further comprising the steps of:

initiating a manipulation operation;

requesting the uncoupling of a first vehicle from a second vehicle;

verifying at least one of train length and a communication link between the central control mechanism, the first vehicle control mechanism and the second vehicle control mechanism;

verifying the position of other trains in the transit system;

assigning a lead control vehicle in the train; and uncoupling the first vehicle from the second vehicle.

45. The method of claim 44, further comprising the steps of:

braking the first vehicle, thereby disconnecting the first vehicle from the second vehicle;

braking the second vehicle; and determining the adjusted train length.

46. The method of claim 45, further comprising the steps of:

determining a first train length and a second train length;

placing a protection zone around the first train and the second train;

storing vehicle data for the vehicles in the first train and the second train;

verifying the vehicle data for the first train and the second train; and resolving the vehicle data for the first train and the second train.

47. The method of claim 46, further comprising the steps of:

selecting a control vehicle for the first train and the second train; and assigning a group identifier to all vehicles in the same train.

48. The method of claim 47, further comprising the steps of:

confirming the initialization status of the first train and the second train;

releasing the braking of the second train;

providing the second train with an uncouple route, thereby guiding the second train away from the first train;

verifying that the second train has completed the uncouple route;

removing the protection zone from around the second train; and routing the second train in the direction of traffic for normal operation in the transit system.

49. The method of claim 48, further comprising the step of removing the first train from the transit system via a transfer table.

50. The method of claim 34, further comprising at least one of the steps of:

regulating vital train functions within a specified region;

selecting a train route;

determining a conflict point;

regulating non-vital train functions;

displaying a signal;

regulating vital vehicle functions;

determining positive train separation;

determining safe speed;

enabling vehicle door operation;

initializing a train;

controlling a trainline;

monitoring a trainline;

processing a sensor signal;

holding a vehicle in a stopped position during passenger exchange;

communicating with the central control mechanism;

regulating non-vital vehicle functions;

controlling speed under safe speed limit;

opening and closing a door;

controlling passenger information devices;

displaying information on a diagnostic display; and logging diagnostic data and fault data.

51. The method of claim 34, further comprising at least one of the steps of:

validating that a transfer table contains an initialized vehicle;

verifying that at least one other vehicle on a guideway is not stopped outside of a station during a manipulation operation;

verifying that the transfer table is in an appropriate position; and verifying that coupling and uncoupling conditions are met prior to a coupling and uncoupling operation.

* * * * *